US007441566B2

(12) United States Patent
Ward

(10) Patent No.: US 7,441,566 B2
(45) **Date of Patent: *Oct. 28, 2008**

(54) MACHINE DIRECTION YARN STITCHED TRIPLE LAYER PAPERMAKER'S FORMING FABRICS

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 171 days.

This patent is subject to a terminal disclaimer.

(21) Appl. No.: 10/548,637

(22) PCT Filed: Mar. 18, 2004

(86) PCT No.: PCT/US2004/008311

§ 371 (c)(1),
(2), (4) Date: Nov. 20, 2006

(87) PCT Pub. No.: WO2004/085741

PCT Pub. Date: Oct. 7, 2004

(65) Prior Publication Data

US 2007/0157987 A1 Jul. 12, 2007

(51) Int. Cl.
*D21F 1/00* (2006.01)
*D21F 7/08* (2006.01)
*D03D 25/00* (2006.01)

(52) U.S. Cl. ..... 139/383 A; 139/383 AA; 139/383 R; 162/900; 442/203

(58) Field of Classification Search ..... 139/383 A, 139/383 AA, 383 R; 442/203, 205; 162/900, 162/358.2, 901, 903
See application file for complete search history.

(56) References Cited

U.S. PATENT DOCUMENTS 2,172,430 A 9/1939 Barrell
2,554,034 A 5/1951 Koester et al.
3,094,149 A 6/1963 Keily
3,325,909 A 6/1967 Clark
4,093,512 A 6/1978 Fleischer (Continued)

FOREIGN PATENT DOCUMENTS

DE 454 092 12/1927

(Continued)

OTHER PUBLICATIONS

International Search Report for PCT/US2004/008311.

(Continued)

*Primary Examiner*—Bobby H Muromoto, Jr.
(74) *Attorney, Agent, or Firm*—Myers Bigel Sibley & Sajovec

(57) ABSTRACT

Triple layer papermaker's forming fabrics having a set of top MD yarns that are interwoven exclusively with a set of top CMD yarns to form at least part of a top fabric layer and a set of bottom MD yarns that are interwoven exclusively with a set of bottom CMD yarns to form at least part of a bottom fabric layer are provided. These fabrics further include a set of stitching MD yarn pairs. The stitching MD yarns that comprise each such pair weave in both the top fabric layer and the bottom fabric layer such that at locations where the first yarn in the pair weaves in the top fabric layer the second yarn in the pair drops down into the bottom fabric layer. In embodiments of the present invention, each stitching MD yarn may also be woven so as to form side-by-side machine direction knuckles on the bottom surface of the bottom fabric layer with a bottom MD yarn. In other embodiments of the invention, at least some of the top CMD yarns that the stitching MD yarns of the stitching MD yarns pairs pass over immediately before dropping down into the bottom fabric layer have a larger diameter and/or a higher modulus than the remainder of the top CMD yarns.

26 Claims, 22 Drawing Sheets

U.S. PATENT DOCUMENTS

| | | | | |
|---|---|---|---|---|
| 4,182,381 | A | | 1/1980 | Gisbourne |
| 4,244,543 | A | | 1/1981 | Ericson |
| 4,289,173 | A | | 9/1981 | Miller |
| 4,290,209 | A | | 9/1981 | Buchanan et al. |
| 4,414,263 | A | | 11/1983 | Miller et al. |
| 4,438,788 | A | | 3/1984 | Harwood |
| 4,452,284 | A | | 6/1984 | Eckstein et al. |
| 4,453,573 | A | | 6/1984 | Thompson |
| 4,501,303 | A | | 2/1985 | Osterberg |
| 4,515,853 | A | | 5/1985 | Borel |
| 4,529,013 | A | | 7/1985 | Miller |
| 4,564,052 | A | | 1/1986 | Borel |
| 4,564,551 | A | | 1/1986 | Best |
| 4,592,395 | A | | 6/1986 | Borel |
| 4,592,396 | A | | 6/1986 | Borel et al. |
| 4,605,585 | A | | 8/1986 | Johansson |
| 4,611,639 | A | | 9/1986 | Bugge |
| 4,621,663 | A | | 11/1986 | Malmendier |
| 4,633,596 | A | | 1/1987 | Josef |
| 4,636,426 | A | | 1/1987 | Fleischer |
| 4,642,261 | A | | 2/1987 | Fearnhead |
| 4,676,278 | A | | 6/1987 | Dutt |
| 4,705,601 | A | | 11/1987 | Chiu |
| 4,709,732 | A | | 12/1987 | Kinnunen |
| 4,729,412 | A | | 3/1988 | Bugge |
| 4,731,281 | A | | 3/1988 | Fleischer et al. |
| 4,739,803 | A | | 4/1988 | Borel |
| 4,755,420 | A | | 7/1988 | Baker et al. |
| 4,759,975 | A | | 7/1988 | Sutherland et al. |
| 4,815,499 | A | | 3/1989 | Johnson |
| 4,815,503 | A | | 3/1989 | Borel |
| 4,909,284 | A | | 3/1990 | Kositzke |
| RE33,195 | E | | 4/1990 | McDonald et al. |
| 4,934,414 | A | | 6/1990 | Borel |
| 4,941,514 | A | | 7/1990 | Taipale |
| 4,942,077 | A | | 7/1990 | Wendt et al. |
| 4,945,952 | A | | 8/1990 | Vöhringer |
| 4,967,805 | A | | 11/1990 | Chiu et al. |
| 4,987,929 | A | | 1/1991 | Wilson |
| 4,989,647 | A | | 2/1991 | Marchand |
| 4,989,648 | A | | 2/1991 | Tate et al. |
| 4,998,568 | A | | 3/1991 | Vohringer |
| 4,998,569 | A | | 3/1991 | Tate |
| 5,022,441 | A | | 6/1991 | Tate et al. |
| 5,025,839 | A | | 6/1991 | Wright |
| 5,067,526 | A | | 11/1991 | Herring |
| 5,074,339 | A | | 12/1991 | Vohringer |
| 5,084,326 | A | | 1/1992 | Vohringer |
| 5,092,372 | A | | 3/1992 | Fitzka et al. |
| 5,101,866 | A | | 4/1992 | Quigley |
| 5,116,478 | A | | 5/1992 | Tate et al. |
| 5,152,326 | A | | 10/1992 | Vohringer |
| 5,158,118 | A | | 10/1992 | Tate et al. |
| 5,219,004 | A | | 6/1993 | Chiu |
| 5,228,482 | A | | 7/1993 | Fleischer |
| 5,277,967 | A | | 1/1994 | Zehle et al. |
| 5,358,014 | A | | 10/1994 | Kovar |
| 5,421,374 | A | | 6/1995 | Wright |
| 5,421,375 | A | | 6/1995 | Praetzel |
| 5,429,686 | A | | 7/1995 | Chiu et al. |
| 5,437,315 | A | | 8/1995 | Ward |
| 5,449,026 | A | | 9/1995 | Lee |
| 5,454,405 | A | | 10/1995 | Hawes |
| 5,456,293 | A | | 10/1995 | Ostermayer et al. |
| 5,465,764 | A | | 11/1995 | Eschmann et al. |
| 5,482,567 | A | | 1/1996 | Barreto |
| 5,487,414 | A | | 1/1996 | Kuji et al. |
| 5,518,042 | A | | 5/1996 | Wilson |
| 5,520,225 | A | | 5/1996 | Quigley et al. |
| 5,542,455 | A | | 8/1996 | Ostermayer et al. |
| 5,555,917 | A | | 9/1996 | Quigley |
| 5,564,475 | A | | 10/1996 | Wright |
| 5,641,001 | A | | 6/1997 | Wilson |
| 5,651,394 | A | | 7/1997 | Marchand |
| 5,709,250 | A | | 1/1998 | Ward et al. |
| RE35,777 | E | | 4/1998 | Givin |
| 5,746,257 | A | | 5/1998 | Fry |
| 5,826,627 | A | | 10/1998 | Seabrook et al. |
| 5,857,498 | A | | 1/1999 | Barreto et al. |
| 5,881,764 | A | * | 3/1999 | Ward ..... 139/383 A |
| 5,894,867 | A | | 4/1999 | Ward et al. |
| 5,899,240 | A | | 5/1999 | Wilson |
| 5,937,914 | A | | 8/1999 | Wilson |
| 5,967,195 | A | * | 10/1999 | Ward ..... 139/383 A |
| 5,983,953 | A | | 11/1999 | Wilson |
| 6,073,661 | A | | 6/2000 | Wilson |
| 6,112,774 | A | | 9/2000 | Wilson |
| 6,123,116 | A | * | 9/2000 | Ward et al. ..... 139/383 A |
| 6,145,550 | A | * | 11/2000 | Ward ..... 139/383 A |
| 6,148,869 | A | | 11/2000 | Quigley |
| 6,158,478 | A | | 12/2000 | Lee et al. |
| 6,179,013 | B1 | * | 1/2001 | Gulya ..... 139/383 A |
| 6,179,965 | B1 | * | 1/2001 | Cunnane et al. ..... 162/358.2 |
| 6,202,705 | B1 | | 3/2001 | Johnson et al. |
| 6,207,598 | B1 | * | 3/2001 | Lee et al. ..... 442/206 |
| 6,227,255 | B1 | | 5/2001 | Osterberg et al. |
| 6,237,644 | B1 | * | 5/2001 | Hay et al. ..... 139/383 A |
| 6,240,973 | B1 | * | 6/2001 | Stone et al. ..... 139/383 A |
| 6,244,306 | B1 | * | 6/2001 | Troughton ..... 139/383 A |
| 6,253,796 | B1 | * | 7/2001 | Wilson et al. ..... 139/383 A |
| 6,276,402 | B1 | * | 8/2001 | Herring ..... 139/383 A |
| 6,379,506 | B1 | * | 4/2002 | Wilson et al. ..... 162/348 |
| 6,581,645 | B1 | * | 6/2003 | Johnson et al. ..... 139/383 A |
| 6,585,006 | B1 | * | 7/2003 | Wilson et al. ..... 139/383 A |
| 6,745,797 | B2 | * | 6/2004 | Troughton ..... 139/383 A |
| 6,837,277 | B2 | * | 1/2005 | Troughton et al. ..... 139/383 A |
| 6,860,969 | B2 | * | 3/2005 | Troughton ..... 162/348 |
| 6,896,009 | B2 | * | 5/2005 | Ward ..... 139/383 A |
| 6,959,737 | B2 | * | 11/2005 | Ward ..... 139/383 A |
| 7,059,357 | B2 | * | 6/2006 | Ward ..... 139/348 |
| 7,059,359 | B2 | * | 6/2006 | Quigley et al. ..... 139/383 A |
| 7,195,040 | B2 | * | 3/2007 | Ward ..... 139/383 A |
| 7,219,701 | B2 | * | 5/2007 | Ward ..... 139/383 A |
| 7,243,687 | B2 | * | 7/2007 | Barratte ..... 139/383 A |
| RE40,066 | E | * | 2/2008 | Ward ..... 139/383 A |
| 7,357,155 | B2 | * | 4/2008 | Fahrer et al. ..... 139/382 A |
| 7,357,157 | B2 | * | 4/2008 | Ueda ..... 139/383 A |
| 2003/0010393 | A1 | | 1/2003 | Kuji |
| 2004/0079434 | A1 | | 4/2004 | Martin et al. |
| 2004/0102118 | A1 | | 5/2004 | Hay et al. |
| 2004/0149342 | A1 | * | 8/2004 | Troughton ..... 139/383 R |
| 2004/0182464 | A1 | * | 9/2004 | Ward ..... 139/383 A |
| 2004/0182465 | A1 | * | 9/2004 | Ward ..... 139/383 A |
| 2005/0121097 | A1 | * | 6/2005 | Ward ..... 139/383 A |
| 2006/0185753 | A1 | * | 8/2006 | Ward ..... 139/383 A |
| 2007/0068591 | A1 | * | 3/2007 | Ward ..... 139/383 A |
| 2007/0157987 | A1 | * | 7/2007 | Ward ..... 139/383 A |
| 2007/0199609 | A1 | * | 8/2007 | Ward ..... 139/383 A |
| 2007/0251594 | A1 | * | 11/2007 | Ward et al. ..... 139/383 R |

FOREIGN PATENT DOCUMENTS

| | | | |
|---|---|---|---|
| DE | 33 29 740 | | 3/1985 |
| EP | 0 048 962 | | 9/1981 |
| EP | 0 158 710 | | 10/1984 |
| EP | 0 185 177 | | 10/1985 |
| EP | 0 224 276 | | 12/1986 |
| EP | 0 264 881 | | 10/1987 |
| EP | 0 269 070 | | 11/1987 |
| EP | 0 284 575 | | 2/1988 |
| EP | 0 283 181 | | 3/1988 |
| EP | 0 350 673 | | 6/1989 |
| EP | 0 408 849 | A2 | 5/1990 |
| EP | 0 408 849 | A3 | 5/1990 |

| | | | |
|---|---|---|---|
| EP | 0 672 782 | | 3/1995 |
| EP | 0 794 283 | A1 | 9/1997 |
| FR | 2 597 123 | | 4/1986 |
| GB | 2157328 | A | 10/1985 |
| GB | 2245006 | | 2/1991 |
| JP | 8-158285 | | 12/1994 |
| WO | WO 86/00099 | | 1/1986 |
| WO | WO 89/09848 | | 4/1989 |
| WO | WO 99/61698 | | 12/1999 |
| WO | WO 02/00996 | | 1/2002 |
| WO | WO 03/010304 | | 6/2003 |
| WO | WO 03/093573 | A1 | 11/2003 |

OTHER PUBLICATIONS

European Search Report corresponding to application No. EP 05002306.8, dated Oct. 18, 2005.

International Search Report for PCT Application No. PCT/US97/18629.

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

* cited by examiner

MACHINE DIRECTION YARN STITCHED TRIPLE LAYER PAPERMAKER'S FORMING FABRICS

CLAIM FOR PRIORITY AND CROSS-REFERENCE TO OTHER APPLICATIONS

This application claims priority to parent application number PCT/US2004/008311 filed Mar 18, 2004, which claims priority to U.S. patent application Ser. No. 10/391,827, filed Mar. 19, 2003, now U.S Pat. No. 6,896,009, the disclosures of which are hereby incorporated herein by reference.

FIELD OF THE INVENTION

The present invention relates generally to papermaking, and relates more specifically to forming fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaling surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. No. 5,437,315 to Ward and U.S. Pat. No. 5,967,195 to Ward.

SUMMARY OF THE INVENTION

The present invention relates to machine direction yarn stitched triple layer papermaker's forming fabrics which can exhibit relatively good drainage, permeability and machine direction yarn stacking characteristics, and in some instances may have reduced diagonal marking.

In one embodiment of the present invention, a triple layer papermaker's fabric includes: a set of top CMD yarns; a set of top MD yarns interwoven exclusively with the top CMD yarns to form at least part of a top fabric layer having a papermaking surface; a set of bottom CMD yarns; a set of bottom MD yarns interwoven exclusively with the bottom CMD yarns to form at least part of a bottom fabric layer having a machine side surface, the bottom MD yarns forming bottom MD knuckles as they pass below bottom CMD yarns; and a pair of additional MD yarns disposed on either side of each top MD yarn, wherein the first yarn of each pair of additional MD yarns weaves exclusively in the top fabric layer and the second yarn of each pair of additional MD yarns completes the weave of the first yarn of each pair of additional MD yarns on the papermaking surface and also weaves with the bottom fabric layer beneath a bottom CMD yarn to form a bottom MD stitching yarn knuckle so as to bind the top fabric layer and the bottom fabric layers together. Each bottom stitching yarn knuckle is formed below a bottom CMD yarn under which an adjacent bottom MD yarn forms a bottom MD knuckle.

In another embodiment of the present invention, a triple layer papermaker's forming fabric includes: a set of top CMD yarns; a set of top MD yarns interwoven exclusively with the top CMD yarns to form at least part of a top fabric layer having a papermaking surface; a set of bottom CMD yarns; a set of bottom MD yarns interwoven exclusively with the bottom CMD yarns to form at least part of a bottom fabric layer having a machine side surface, the bottom MD yarns forming bottom MD knuckles as they pass below bottom CMD yarns; and a pair of additional MD yarns disposed on either side of each top MD yarn, wherein the first yarn of each pair of additional MD yarns weaves exclusively in the top fabric layer and the second yarn of each pair of additional MD yarns completes the weave of the first yarn of each pair of additional MD yarns on the papermaking surface and also weaves with the bottom fabric layer beneath a bottom CMD yarn to form a bottom MD stitching yarn knuckle so as to bind the top fabric layer and the bottom fabric layers together. In this embodiment, each of the additional MD yarns forms knuckles by passing over the top CMD yarns, and wherein the number of knuckles formed by the first yarn of each pair of additional MD yarns differs from the number of knuckles formed by the second yarn of each pair.

Another aspect of the present invention includes methods of using a triple layer papermaker's forming fabric as described above for making paper.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments or other embodiments set forth herein; rather, these embodiments are provided so that this disclosure will be thorough and complete, and will fully convey the scope of the invention to those skilled in the art. In the figures, the dimensions of some components may be exaggerated for clarity.

One aspect of the present invention is directed to machine direction yarn stitched triple layer papermaker's forming fabrics that include both a top fabric layer and a bottom fabric layer. These fabrics are "true" triple layer fabrics in that they include sets of machine direction yarns and cross machine direction yarns that only weave in the top fabric layer, as well as sets of machine direction yarns and cross machine direction yarns that only weave in the bottom fabric layer. The fabrics also include pairs of adjacent machine direction yarns that together replace the equivalent of a single machine direction yarn in the weave pattern on the papermaking surface. These yarns are woven such that when one yarn in the pair is weaving in the top fabric layer so as to complete the weave pattern on the papermaking surface, the second yarn in the pair weaves below the papermaking surface. Throughout the fabric, these yarns trade these positions. At least one of the yarns in the pair also drops down to the bottom fabric layer at one or more points so as to bind the top and bottom fabric layers together. Herein, these yarn pairs are referred to as "stitching MD yarn pairs" (even in those embodiments in which only one yarn of the pair actually "stitches" with the bottom fabric layer). Individual yarns from these yarn pairs are typically referred to as a "stitching MD yarn."

Figure 1:
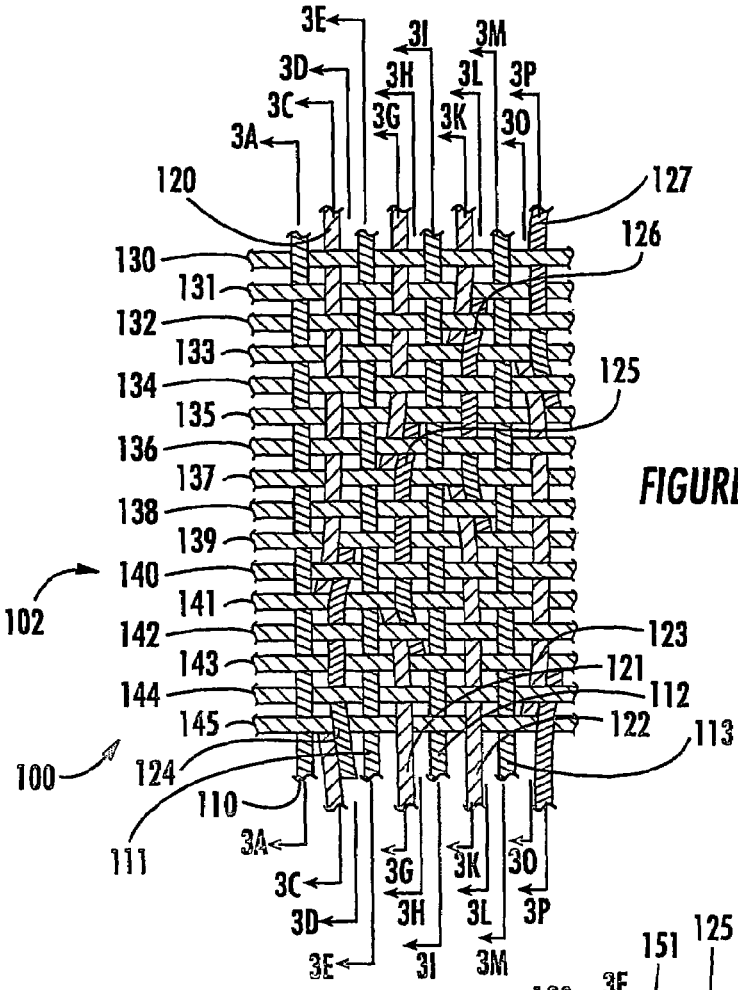
FIG. 1 is a top view of the top fabric layer of an embodiment of a 16 harness triple layer forming fabric of the present invention.
Figure 2:
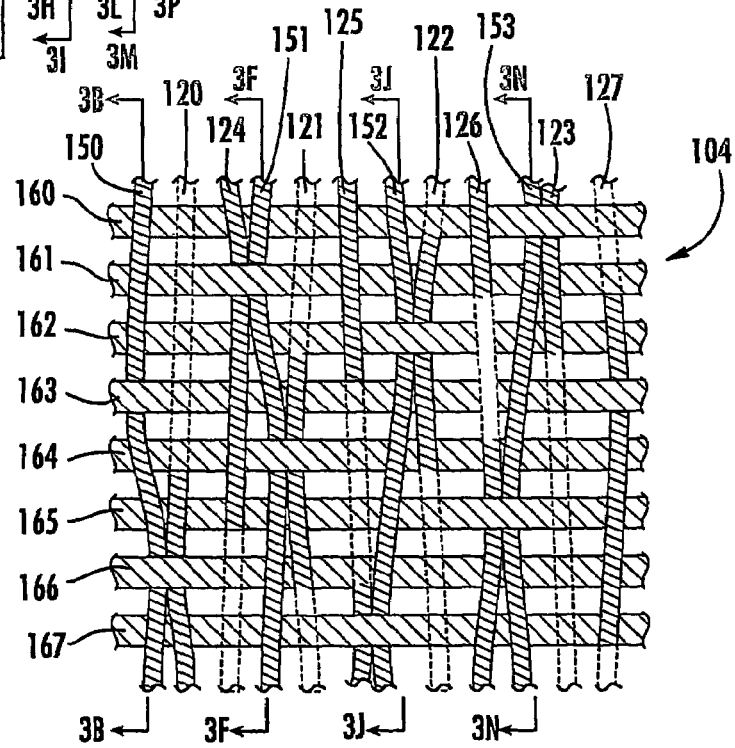
FIG. 2 is a top view of the bottom fabric layer of the triple layer forming fabric of FIG. 1.

An embodiment of the machine direction yarn stitched triple layer fabrics of the present invention is illustrated in FIGS. 1-3 and designated broadly at 100. FIG. 1 depicts a top view of the top fabric layer 102 of the triple layer fabric 100 (i.e., a view of the papermaking surface) while FIG. 2 depicts a top view of the bottom fabric layer 104 of fabric 100 (i.e., a view of the fabric 100 with the yarns that weave exclusively in the top fabric layer 102 removed). FIGS. 3A-3P depict the paths of each of the machine direction yarns in one repeat unit of the fabric 100. The triple layer fabric 100 of FIGS. 1-3 is woven on 16 harnesses, and hence a single repeat of the fabric encompasses 16 machine direction yarns. While FIGS. 1 and 2 only show a single repeat unit of the fabric, those of skill in the art will appreciate that in commercial applications the repeat unit shown in FIGS. 1 and 2 would be repeated many times, in both the machine and cross machine directions, to form a large fabric suitable for use on a papermaking machine.

As seen in FIG. 1, the repeat unit of the top fabric layer 102 includes a set of top MD yarns 110-113 and a set of top CMD yarns 130-145 that are interwoven together. The top fabric layer further includes a set of four stitching MD yarn pairs 120, 124; 121, 125; 122, 126; 123, 127 that also interweave with the top CMD yarns 130-145. As shown in FIG. 1, a stitching MD yarn pair, such as for example, stitching MD yarn pair 120, 124, is provided between each pair of adjacent top MD yarns, such as yarns 110-111. Each stitching MD yarn pair (such as pair 120, 124) is woven such that while one of the yarns of the pair (e.g., yarn 120) weaves in the top fabric layer 102 to complete the weave pattern in the top fabric layer 102, the other of the stitching MD yarns (e.g., yarn 124) drops down into the bottom fabric layer 104 to bind the top fabric layer 102 and the bottom fabric layer 104 together. In this manner, the stitching MD yarn pairs 120, 124; 121, 125; 122, 126; 123, 127 both complete the weave of the top layer fabric 102 and also serve to bind the top and bottom fabric layers 102, 104 together.

As shown in FIG. 1, the yarns comprising the set of top CMD yarns 130-145 are interwoven with the set of top layer MD yarns 110-113 and the stitching MD yarn pairs 120, 124; 121, 125; 122, 126; 123, 127 in a 1×1 or "plain weave" pattern, meaning that each of the top CMD yarns 130-145 alternatively pass below one, and then above the next, of the machine direction yarns that at that point are weaving in the papermaking surface. For example, top CMD yarn 130 passes below top MD yarn 110, above stitching MD yarn 120, below top MD yarn 111, above stitching MD yarn 121, below top MD yarn 112, above stitching MD yarn 122, below top MD yarn 113, and above stitching MD yarn 127. The other top CMD yarns 131-145 follow an identical "over one/under one" pattern, although this pattern is offset by one machine direction yarn for adjacent top CMD yarns 130-145.

Referring now to FIG. 2, a repeat unit of the top surface of the bottom fabric layer 104 of the fabric 100 is shown. The repeat unit includes a set of bottom MD yarns 150-153 which are interwoven with a set of bottom CMD yarns 160-167. The repeat unit further includes the stitching MD yarn pairs 120, 124; 121, 125; 122, 126; 123, 127 which are described above.

As shown best in FIG. 2, the bottom CMD yarns 160-167 may be constructed using relatively large diameter yarns that are well suited to sustain the wear caused by the friction between the machine side surface of the fabric 100 and the papermaking machine during use of the fabric 100. As can be seen in FIG. 2, the weave pattern of fabric 100 provides relatively long cross machine direction "floats" on the machine side surface, meaning that when viewing the machine side surface (i.e., the bottom surface) of the bottom fabric layer 104, the CMD yarns pass or "float" above large numbers of adjacent machine direction yarns. This may be advantageous in that it allows the larger, sturdier bottom CMD yarns 160-167 to primarily contact the papermaking machine.

As noted above, in the fabric depicted in FIGS. 1 and 2, the top fabric layer 102 (pictured in FIG. 1) and the bottom fabric layer 104 (pictured in FIG. 2) are bound together by the stitching MD yarn pairs 120, 124; 121, 125; 122, 126; 123, 127. In FIG. 1, only those portions of the stitching MD yarns 120-127 which weave with the top fabric layer 102 are depicted. In FIG. 2, the entirety of the stitching MD yarns 120-127 are shown, but those portions of the stitching warp yarn that weave in the top fabric layer are shown using dotted lines.

Figure 3A:
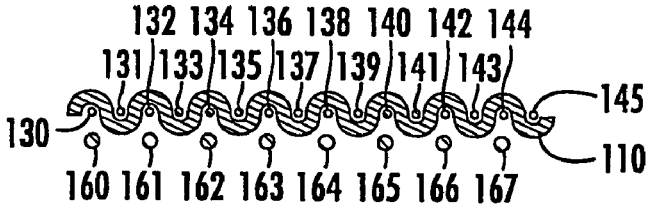
FIGS. 3A-3P are machine direction section views taken along the lines 3A-3A through 3P-3P of FIGS. 1 and 2.
Figure 3B:
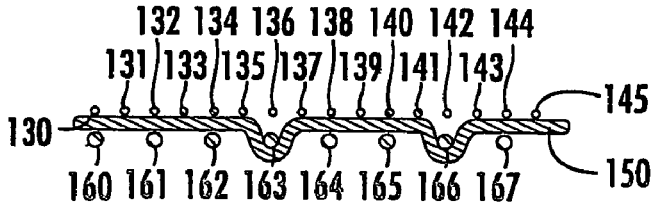
Figure 3C:
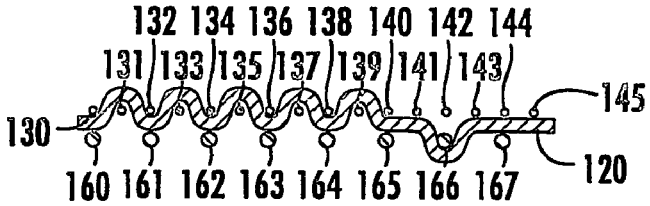
Figure 3D:
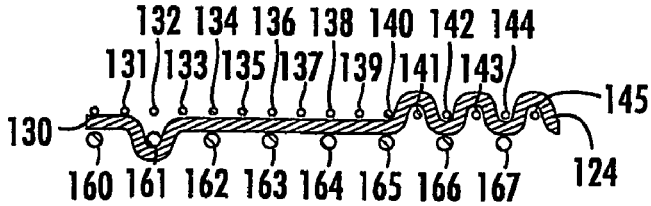
Figure 3E:
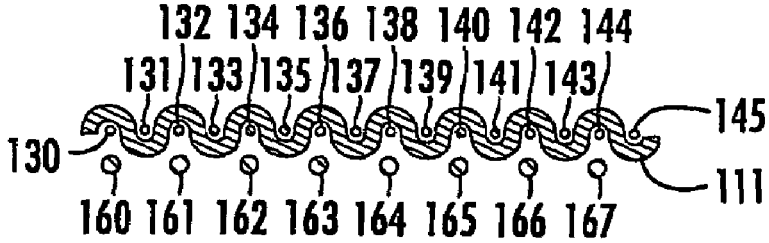
Figure 3F:
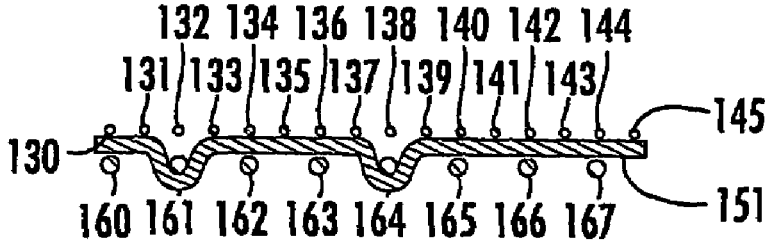
Figure 3G:
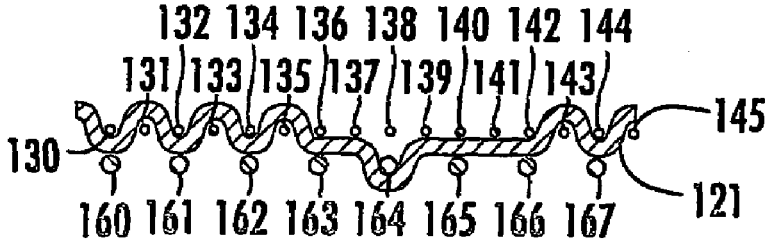
Figure 3H:
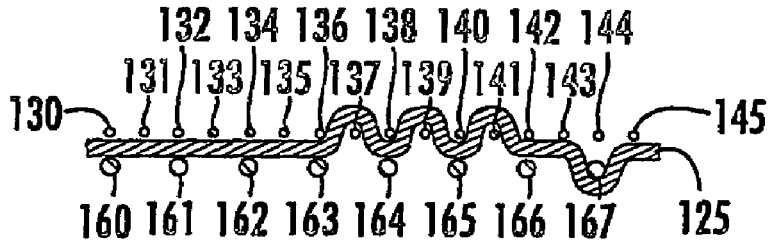
Figure 3I:
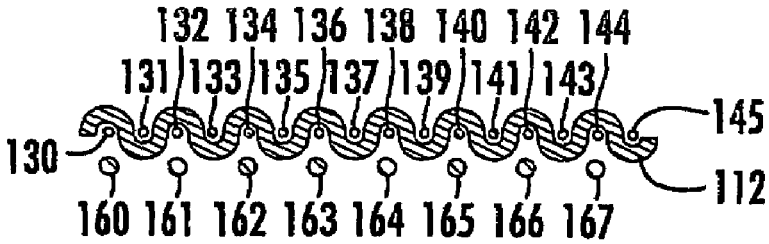
Figure 3J:
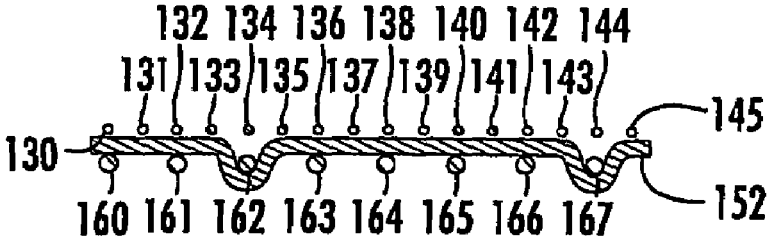
Figure 3K:
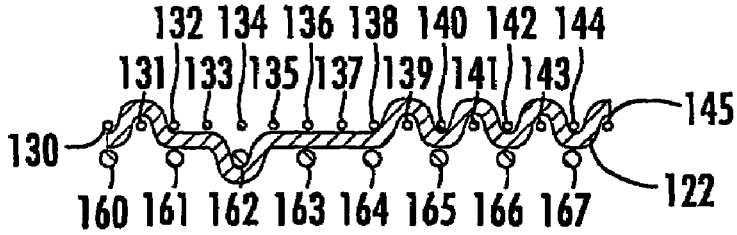
Figure 3L:
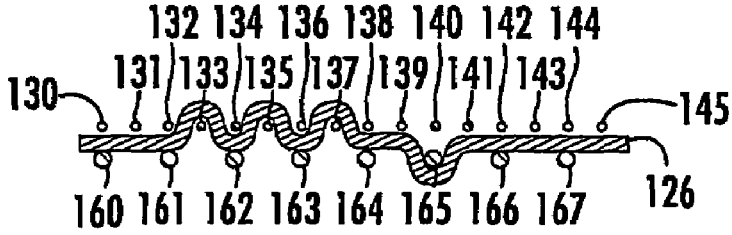
Figure 3M:
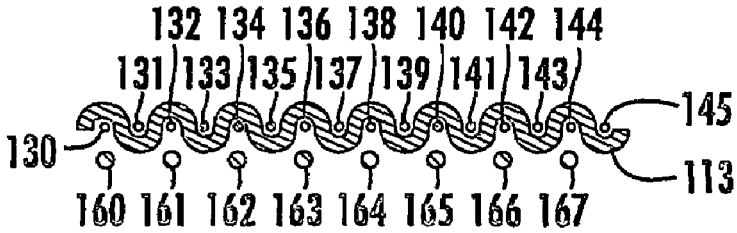
Figure 3N:
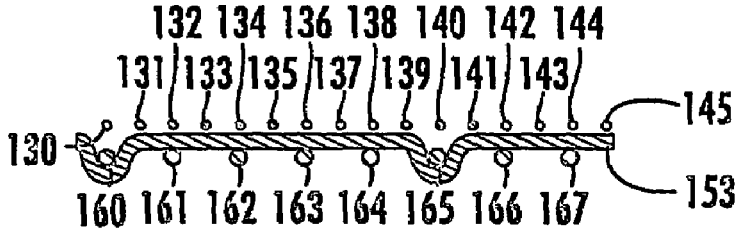
Figure 3O:
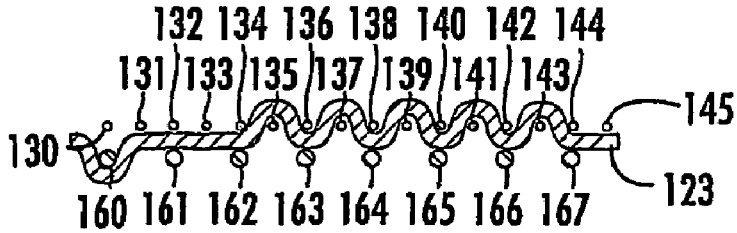
Figure 3P:
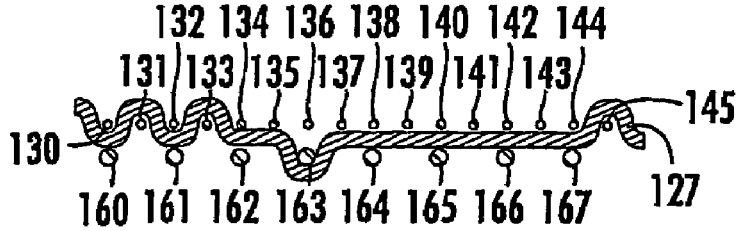

FIGS. 3A-3P depict the individual machine direction yarn paths of each of the sixteen MD yarns in one repeat of the fabric 100. As shown in FIGS. 3A, 3E, 31 and 3M, the top MD yarns 110-113 are woven in identical over-one/under-one patterns with the top CMD yarns 130-145. These top MD yarns 110-113 do not weave with the bottom fabric layer 104. As shown in FIGS. 3B, 3F, 3J and 3K, the bottom MD yarns 150-153 are woven with the bottom CMD yarns 160-167 in an over-four/under-one/over-two/under-one pattern, meaning that each bottom MD yarn 150-153 passes over four yarns in the set of bottom CMD yarns 160-167, below the next bottom CMD yarn, above the next two bottom CMD yarns, and below the next bottom CMD yarn in each repeat unit of the fabric. For example, as shown in FIG. 3F, bottom MD yarn 151 passes above bottom CMD yarns 165-167 and 160, below bottom CMD yarn 161, above bottom CMD yarns 162-163, and below bottom CMD yarn 164. The other bottom CMD yarns 150, 152-153 follow a similar "over-four/under-one/over-two/under-one pattern" weave pattern, although this pattern is offset by two bottom CMD yarns 160-167 for each adjacent bottom MD yarn 151-153.

FIGS. 3C, 3G, 3K and 30 depict the individual machine direction yarn paths for stitching MD yarns 120, 121, 122 and 123, respectively. As shown, yarns 120-123 are woven in identical patterns with the top CMD yarns 130-145 and the bottom CMD yarns 160-167, with each stitching MD yarn 120-123 offset by two bottom CMD yarns (and hence four top CMD yarns) with respect to the stitching MD yarns 120-123 adjacent to it. As shown, for example, in FIG. 3C, stitching MD yarns 120-123 weave with the top CMD yarns 130-145 in an under-one/over-one/under-one/over-one/under-one/over-one/under-one/over-one/under-one/over-one/under-six pattern. The stitching MD yarns also interweave with the bottom CMD yarns 160-167 in an over-seven/under-one pattern.

FIGS. 3D, 3H, 3L and 3P depict the individual machine direction yarn paths for stitching MD yarns 124, 125, 126 and 127, respectively. As shown, yarns 124-127 are woven in identical patterns with the top CMD yarns 130-145 and the bottom CMD yarns 160-167, with each stitching MD yarn 124-127 offset by two bottom CMD yarns (and hence four top CMD yarns) with respect to the stitching MD yarns 124-127 adjacent to it. As shown, for example, in FIG. 3D, stitching MD yarns 120-123 weave with the top CML yarns 130-145 in an under-eleven/over-one/under-one/over-one/under-one/over-one pattern. The stitching MD yarns 124-127 also interweave with the bottom CMD yarns 160-167 in an over-seven/under-one pattern.

As can be seen from FIGS. 1-3, only 50% of the machine direction yarns in the fabric 100 weave in both the top fabric layer 102 and the bottom fabric layer 104. As a result of this configuration, improved "stacking" of the yarns running in the machine direction may be obtained. Specifically, the top MD yarns 110-113 may be arranged so that they are substantially directly above the bottom MD yarns 150-153. Such an arrangement can provide desirable straight through drainage so that water reaching the top surface of the top fabric layer 102 meets relatively large drainage holes between the yarns that go straight through to the bottom of the bottom fabric layer 104. Such an arrangement can provide improved water drainage and easier cleaning, which is a desired fabric feature in many papermaking applications. Additionally, by having less than 100% of the machine direction yarns weaving in both the top and bottom fabric layers 102, 104, it is generally possible to increase permeability and uniformity as compared to an equivalent fabric formed with 67% or 100% of the machine direction yarns configured as stitching yarns such as the fabrics claimed in U.S. Pat. No. 6,202,705 or German patent WO 02/00996-02 A1. These features are also desirable in numerous papermaking applications.

As can also be seen in FIG. 2, each bottom MD yarn 150-153 alternatively comes together with or "couples" with the stitching MD yarns 120-127 that are adjacent to it on each side. Thus, for example, bottom MD yarn 151 couples with stitching MD yarn 121 in the vicinity of bottom CMD yarn 164, while it couples with stitching MD yarn 124 in the vicinity of bottom CMD yarn 161. The pairing occurs proximate the locations where the bottom MD yarns 150-153 pass below the bottom CMD yarns 160-167 such that they are in a position to be protected from coming in contact with the papermaking machine. Often, when two adjacent yarns "couple" in this manner persons of skill in the art refer to the two yarns as "pairing" at the locations where the yarns come together in the weave. However, to avoid confusion given the references to "stitching MD yarn pairs" in this application, the word "couples" will be used to describe situations where two yarns come together within the weave.

The coupling arrangement that occurs between the bottom MD yarns 150-153 and the stitching MD yarns 120-127 may have several beneficial effects in certain applications. First, by coupling at these locations each individual yarn may come into less contact with the papermaking machine since the yarns tend to act to protect each other. This may advantageously extend the life of the fabric, as a potential failure point for the fabric is wear of the MD yarns that come in contact with the papermaking machine. Additionally, having two MD yarns coupled at the locations where the MD yarns float below the CMD yarns potentially acts to increase the upward force on the bottom CMD yarn at that location. This increased upward force helps to "bury" the machine side MD yarn floats up into the bottom fabric layer 104, which further may help to reduce the machine-induced wear on the bottom MD yarns 150-153 and the stitching MD yarns 120-127. Third, as best seen in FIG. 2, a relatively large drainage hole is provided adjacent each location where the coupling occurs. These larger drainage holes may serve to facilitate drainage of water from the fabric 100.

In the embodiment of FIGS. 1-3, all of the stitching MD yarns 120-127 weave in both the top and bottom fabric layers 102, 104 to stitch the fabric layers together. It will be appreciated that not all of the stitching MD yarns need to perform such a stitching function, as is made clear in the description of the following fabric.

Figure 4:
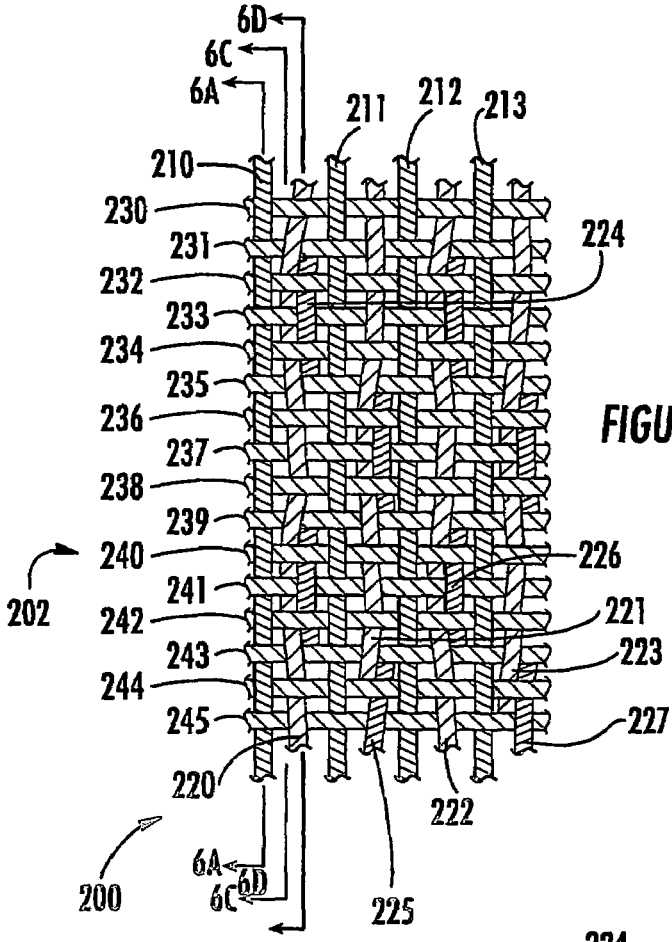
FIG. 4 is a top view of the top fabric layer of another embodiment of a 16 harness triple layer forming fabric of the present invention.
Figure 5:
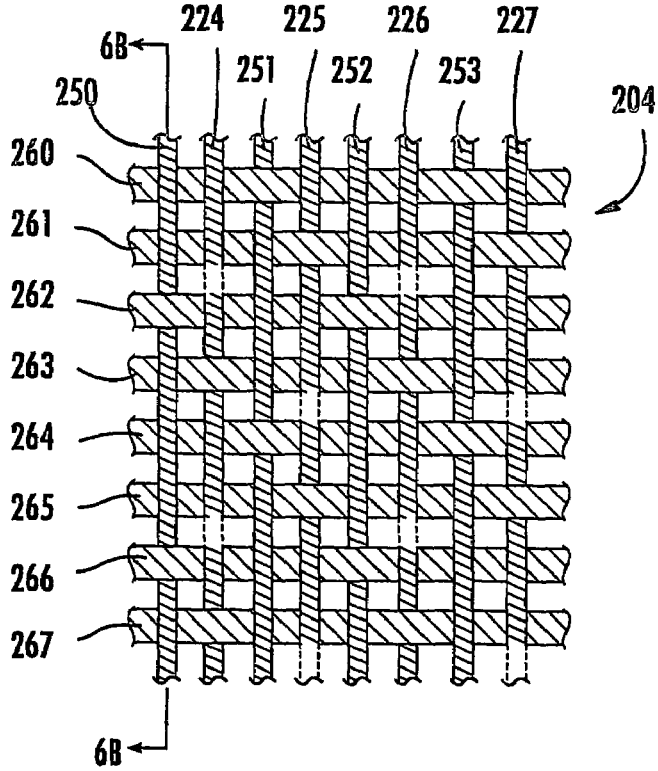
FIG. 5 is a top view of the bottom fabric layer of the triple layer forming fabric of FIG. 4.

Another fabric 200 constructed according to the teachings of the present invention is illustrated in FIGS. 4-6. FIG. 4 depicts a top view of the top fabric layer 202 of the triple layer fabric 200 (i.e., a view of the papermaking surface) while FIG. 5 depicts a top view of the bottom fabric layer 204 of fabric 200 (i.e., a view of the fabric 200 with the yarns that weave exclusively in the top fabric layer 202 removed). FIGS. 6A-6D depict the weave pattern of top MD yarn 210, bottom MD yarn 250, and stitching MD yarns 224 and 220, respectively. Those of skill in the art will appreciate that in commercial applications the depicted portion of the fabric would be repeated many times, in both the machine and cross machine directions.

As seen in FIG. 4 the top fabric layer 202 includes a set of top MD yarns 210-213 and a set of top CMD yarns 230-245 that are interwoven together. The top fabric layer further includes a set of four stitching MD yarn pairs 220, 224; 221, 225; 222, 226; 223, 227 that also interweave with the top CMD yarns 230-245. As shown in FIG. 4, a stitching MD yarn pair, such as for example, stitching MD yarn pair 220, 224, is provided between each pair of adjacent top MD yarns (e.g., yarns 210-211). The stitching MD yarn pairs are woven such that while one of the yarns in the pair (e.g., yarn 220) weaves in the top fabric layer 202 to complete the weave pattern in the top fabric layer 202, the other yarn of the pair (e.g., yarn 224) drops below the papermaking surface. As best seen in FIGS. 6C and 6D, in the embodiment of fabric 200, only one of the two yarns in each stitching MD yarn pair (e.g., yarn 224 in stitching MD yarn pair 220, 224) drops down into the bottom fabric layer 204 to bind the top fabric layer 202 and the bottom fabric layer 204 together. The other yarn in the stitching MD yarn pair (e.g., yarn 220) drops below the papermaking surface and travels between the top fabric layer 202 and the bottom fabric layer 204 at positions in the weave where the second yarn in the stitching MD yarn pair (e.g., yarn 224) travels up to the papermaking surface to complete the weave of the top fabric layer 202.

Referring now to FIG. 5, the machine side surface of the bottom fabric layer 204 is shown. The bottom fabric layer 204 includes a set of bottom MD yarns 250-253 which are interwoven with a set of bottom CMD yarns 260-267. The repeat unit further includes stitching MD yarns 224-227 which, as noted above, weave in both the top fabric layer 202 and the bottom fabric layer 204 to bind the fabric layers together.

As shown in FIG. 5, the bottom CMD yarns 260-267 of fabric 200 may be constructed using relatively large diameter yarns that are well suited to sustain the wear caused by the papermaking machine during use of the fabric 200. As can also be seen in FIG. 5, the weave pattern of fabric 200 provides relatively long cross machine direction "floats" on the machine side surface.

Figure 6A:
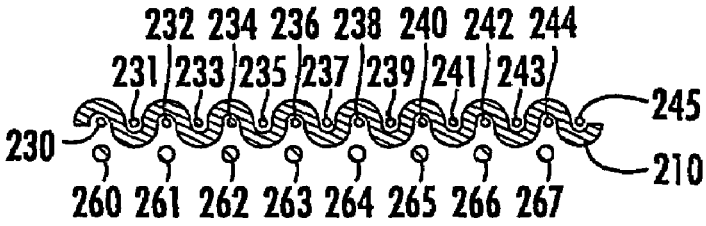
FIGS. 6A-6D are machine direction section views taken along the lines 6A-6A through 6D-6D of FIGS. 4 and 5.
Figure 6B:
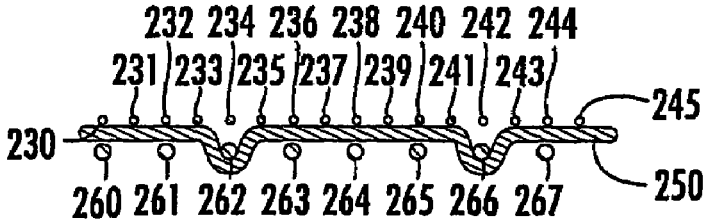
Figure 6C:
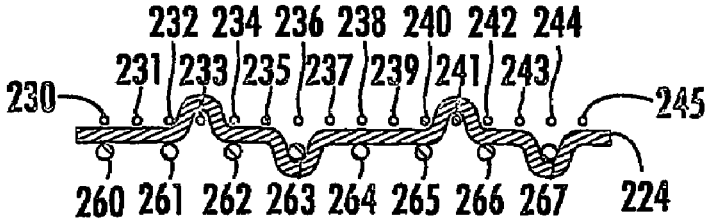
Figure 6D:
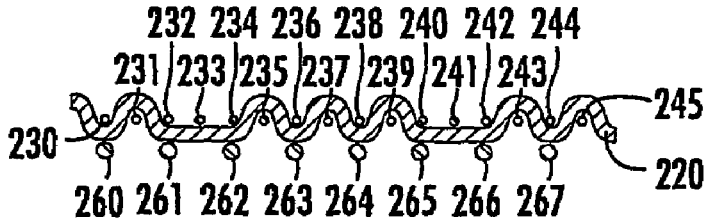

FIGS. 6A-6D depict the individual machine direction yarn paths of representative machine direction yarns in the fabric 200. FIG. 6A depicts the machine direction yarn paths for top MD yarn 210. Top MD yarns 211-213 are woven in identical weave patterns. As shown in FIG. 6A, each of these top MD yarns 210-213 are woven in over-one/under-one patterns with the top CMD yarns 230-245, and do not weave with any yarns in the bottom fabric layer 204.

FIG. 6B depicts the machine direction yarn path of bottom MD yarn 250. As shown in FIG. 6B, bottom MD yarn 250 weaves with the bottom CMD yarns 260-267 in an over-three/under-one/over-three/under-one pattern—i.e., it passes over bottom CMD yarns 267, 260-261, passes under bottom CMD yarn 262, passes over bottom CMD yarns 263-265 and passes under bottom CMD yarn 266 in each repeat of the fabric. The other bottom MD yarns 251-253 follow a similar "over-three/under-one/over-three/under-one pattern" weave pattern, although the starting point for the pattern is offset by two bottom CMD yarns 260-267 for each adjacent bottom MD yarn 250-253.

FIG. 6C depicts the machine direction yarn path of stitching MD yarn 224. As shown in FIG. 6C, stitching MD yarn 224 is woven in an over-three/under-one/over-three/under-one pattern with respect to the bottom CMD yarns 260-267, and is woven in a over-seven/under-one/over-seven/under-one pattern with respect to the top CMD yarns 230-245. Stitching MD yarns 225-227 follow the same patterns with respect to the bottom CMD yarns 260-267 and the top CMD yarns 230-245 as stitching MD yarn 224, except that the starting point for the pattern is offset by two bottom CMD yarns 260-267 (and hence four top CMD yarns 230-245) for each adjacent stitching MD yarn 224-227.

FIG. 6D depicts the machine direction yarn path of stitching MD yarn 220. As shown in FIG. 6D, stitching MD yarn 220 is woven in an under-one/over-one/under-three/over-one/under-one/over-one/under-one/over-one/under-three/over-one/under-one/over-one pattern with respect to the top CMD yarns 230-245. Stitching MD yarn 220 does not weave with the bottom CMD yarns 260-267. Stitching MD yarns 221-223 follow the same patterns with respect to the top CMD yarns 230-245 as stitching MD yarn 220, except that the starting point for the pattern is offset by four top CMD yarns 230-245 for each adjacent stitching MD yarn 220-223.

As shown in FIGS. 6C and 6D, the stitching MD yarn pairs 220, 224; 221, 225; 222, 226; 223, 227 weave in a "dropped knuckle pattern" to complete the weave in the papermaking surface. By "dropped knuckle pattern" it is meant that one of the yarns in each pair (yarns 220-223) substantially completes the weave in the papermaking surface, but occasionally the yarn skips one of the knuckles where it crosses over a top CMD yarn in its over-one/under-one pattern so as to allow the other yarn of the pair (yarns 224-227) to interlace with the top fabric layer. The dropped knuckle pattern may be advantageous in various applications as fine paper, newsprint and brown paper applications.

Pursuant to another aspect of the present invention, it will be realized that the position of the stitching MD yarns in the fabric may have a significant impact on fabric performance. For example, in the fabric 100 of FIGS. 1-3, stitching MD yarns 124-127 may be woven off the same warp beam as bottom MD yarns 150-153 and stitching MD yarns 120-123 may be woven off the same warp beam as top MD yarns 110-113. As can best be seen in FIG. 1, with this weaving configuration, in each stitching MD yarn pair the stitching MD yarns that form five knuckles per repeat on the papermaking surface (yarns 124-127) fall slightly to the left (from the vantage point of FIG. 1) of the stitching yarns that form three knuckles per repeat on the papermaking surface (yarns 120-123). Thus, for example, in FIG. 1 stitching MD yarn 120 falls slightly to the left of stitching MD yarn 124.

Figure 7:
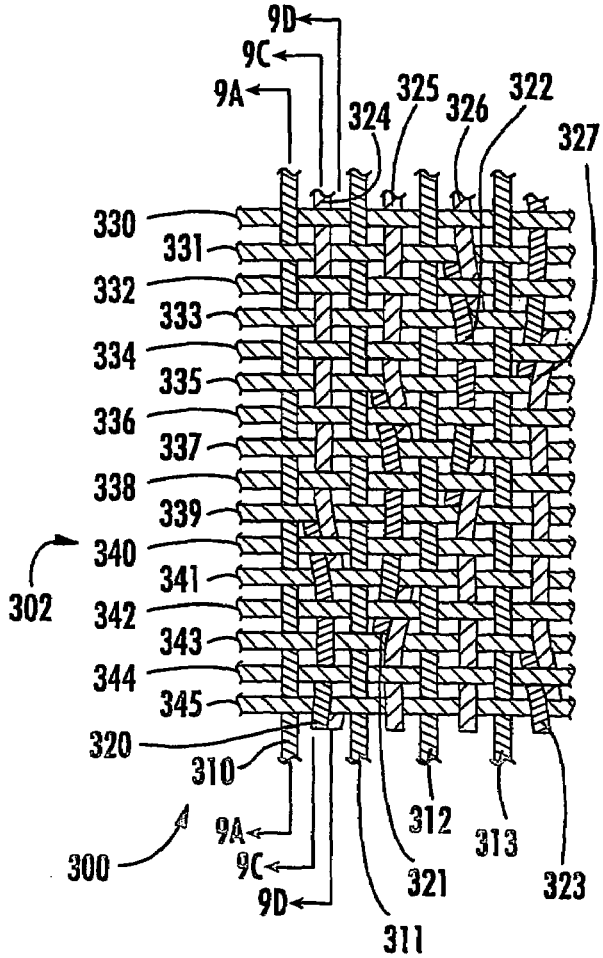
FIG. 7 is a top view of the top fabric layer of another embodiment of a 16 harness triple layer forming fabric of the present invention.

FIG. 7 depicts a top view of the top fabric layer 302 of a triple layer fabric 300 having the reverse weave on the stitching MD yarns. As seen in FIG. 7, the repeat unit of the top fabric layer 302 includes a set of top MD yarns 310-313 and a set of top CMD yarns 330-345 that are interwoven together. The top fabric layer further includes a set of four stitching MD yarn pairs 320, 324; 321, 325; 322, 326; 323, 327 that also interweave with the top CMD yarns 330-345 and that are provided between each pair of adjacent top MD yarns. The stitching MD yarn pairs are woven such that while one of the yarns in the pair (e.g., yarn 320) weaves in the top fabric layer 302 to complete the weave pattern in the top fabric layer 302, the other yarn of the pair (e.g., yarn 324) drops below the papermaking surface.

Figure 8:
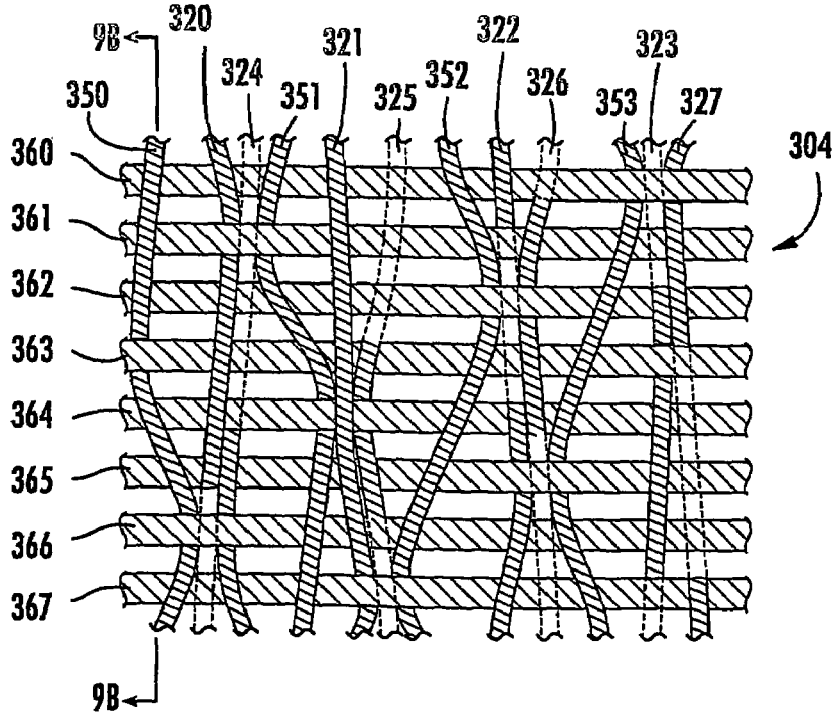
FIG. 8 is a top view of the bottom fabric layer of the triple layer forming fabric of FIG. 7.

FIG. 8 depicts a repeat unit of the machine side surface of the bottom fabric layer 304 of the fabric 300. The repeat unit includes a set of bottom MD yarns 350-353 which are interwoven with a set of bottom CMD yarns 360-367. The repeat unit further includes stitching MD yarns 320-327 which, as noted above, weave in both the top fabric layer 302 and the bottom fabric layer 304 to bind the fabric layers together.

Figure 9A:
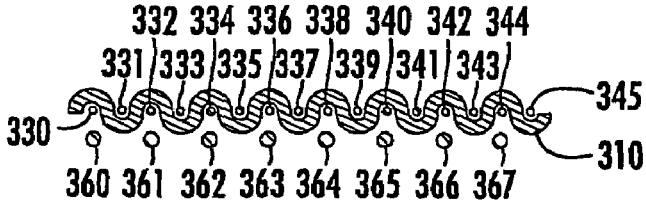
FIGS. 9A-9D are machine direction section views taken along the lines 9A-9A through 9D-9D of FIGS. 7 and 8.

FIGS. 9A-9D depict the individual machine direction yarn paths of representative machine direction yarns in the fabric 300. As shown in FIG. 9A, top MD yarn 310, as well as top MD yarns 311-313, are woven in over-one/under-one patterns with the top CMD yarns 330-345, and do not weave with any yarns in the bottom fabric layer 304.

Figure 9B:
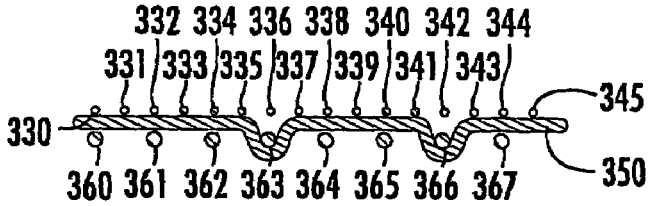

FIG. 9B depicts the machine direction yarn path of bottom MD yarn 350. As shown in FIG. 9B, bottom MD yarn 350 weaves with the bottom CMD yarns 360-367 in an over-four/under-one/over-two/under-one pattern—i.e., it passes over bottom CMD yarns 367, 360-362, passes under bottom CMD yarn 363, passes over bottom CMD yarns 364-365 and passes under bottom CMD yarn 366 in each repeat of the fabric. The other bottom MD yarns 351-353 follow a similar "over-four/under-one/over-two/under-one pattern" weave pattern, although the starting point for the pattern is offset by two bottom CMD yarns 360-367 for each adjacent bottom MD yarn 350-353.

Figure 9D:
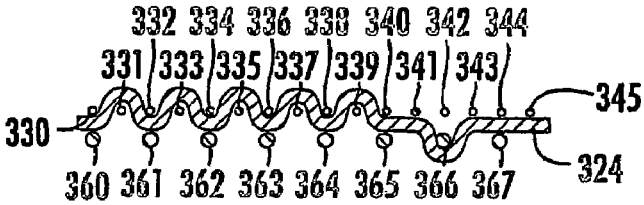
Figure 9C:
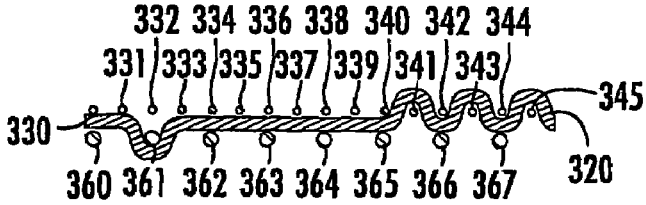

FIG. 9C depicts the machine direction yarn path of stitching MD yarn 320. As shown in FIG. 9C, stitching MD yarn 320 is woven in an over-seven/under-one pattern with respect to the bottom CMD yarns 360-367, and is woven in an under-eleven/over-one/under-one/over-one/under-one/over-one pattern with respect to the top CMD yarns 330-345. Stitching MD yarns 321-323 follow the same patterns with respect to the bottom CMD yarns 360-367 and the top CMD yarns 330-345 as stitching MD yarn 320, except that the starting point for the pattern is offset by two bottom CMD yarns 360-367 (and hence four top CMD yarns 330-345) for each adjacent stitching MD yarn 324-327.

FIG. 9D depicts the machine direction yarn path of stitching MD yarn 324. As shown in FIG. 9D, stitching IM yarn 324 is woven in an under-one/over-one/under-one/over-one/under-one/over-one/under-one/over-one/under-one/over-one/under-six pattern with respect to the top CMD yarns 330-345. Stitching MD yarn 324 weaves with the bottom CMD yarns 360-367 in an over seven/under-one pattern. Stitching MD yarns 325-327 follow the same patterns with respect to the top CMD yarns 330-345 as stitching MD yarn 324, except that the starting point for the pattern is offset by four top CMD yarns 330-345 for each adjacent stitching MD yarn 324-327.

The fabric 300 depicted in FIGS. 7-9 is very similar to the fabric 100 depicted in FIGS. 1-3, the only difference being that the positions of the stitching MD yarn pairs are reversed in the two fabrics. Thus, in fabric 100, the stitching MD yarns 120-123 that form five knuckles per repeat on the papermaking surface fall to the left (from the vantage point of FIG. 1) of the stitching MD yarns 124-127 that form three knuckles per repeat on the papermaking surface, while in fabric 300 the stitching MD yarns 324-327 that form five knuckles per repeat on the papermaking surface fall to the right (from the vantage point of FIG. 7) of the stitching MD yarns 320-323 that form three knuckles per repeat on the papermaking surface.

As shown best in FIG. 8, reversing the position of the stitching MD yarns can result in a significant change in positioning of the yarns in the bottom fabric layer 304. In particular, the machine direction yarns weaving in the bottom fabric layer 304 take more of a zig-zag pattern (as compared to the bottom fabric layer 104 depicted in FIG. 2), which can improve the straight through drainage in fabric 300. The zig-zag pattern results because each stitching MD yarn tends to couple with a specific bottom MD yarn, namely the bottom MD yarn that passes underneath the same bottom CMD yarn as does the stitching MD yarn. In the fabric 300, each bottom MD yarn and the stitching MD yarn with which it pairs are separated by one other stitching MD yarn. As a result, each bottom MD yarn and the stitching MD yarns with which it alternatively couples must travel farther across the fabric to perform the alternative coupling, thereby providing more of a zig-zag pattern. By way of example, bottom MD yarn 351 couples with stitching MD yarn 320 where those two yarns pass under bottom CMD yarn 361. As shown in FIG. 8, stitching MD yarn 324 lies between (and above) bottom MD yarn 351 and stitching MD yarn 320. As a result, bottom MD yarn 351 tends to bend heavily to the left and stitching MD yarn 320 tends to bend heavily to the right so that the two yarns may couple together at the location where they both pass beneath bottom CMD yarn 361. Likewise, stitching MD yarn 321 lies between (and above) bottom MD yarn 351 and stitching MD yarn 325. Bottom MD yarn 351 thus tends to bend heavily to the right and stitching MD yarn 325 tends to bend heavily to the left so that the two yarns may couple together at the location where they both pass beneath bottom CMD yarn 364. This tendency of the bottom MD yarns and the stitching MD yarns (at locations where they weave in the bottom fabric layer) to lean first to the left and then to the right results in the zig-zag pattern.

Note that in fabric 300, the stitching MD yarns in each stitching MD yarn pair are pulled toward each other by the forces that cause those yarns to couple with the bottom MD yarns. As a result, the stitching MD yarns tend to align themselves approximately halfway between the bottom MD yarns (except at the locations where they couple with a bottom MD yarn), which provides for improved straight through drainage in the fabric. In contrast, in the fabric 100 of FIGS. 1-3, the stitching MD yarns in each stitching MD yarn pair are pulled away from each other toward the bottom MD yarn which they are adjacent to.

Figure 10:
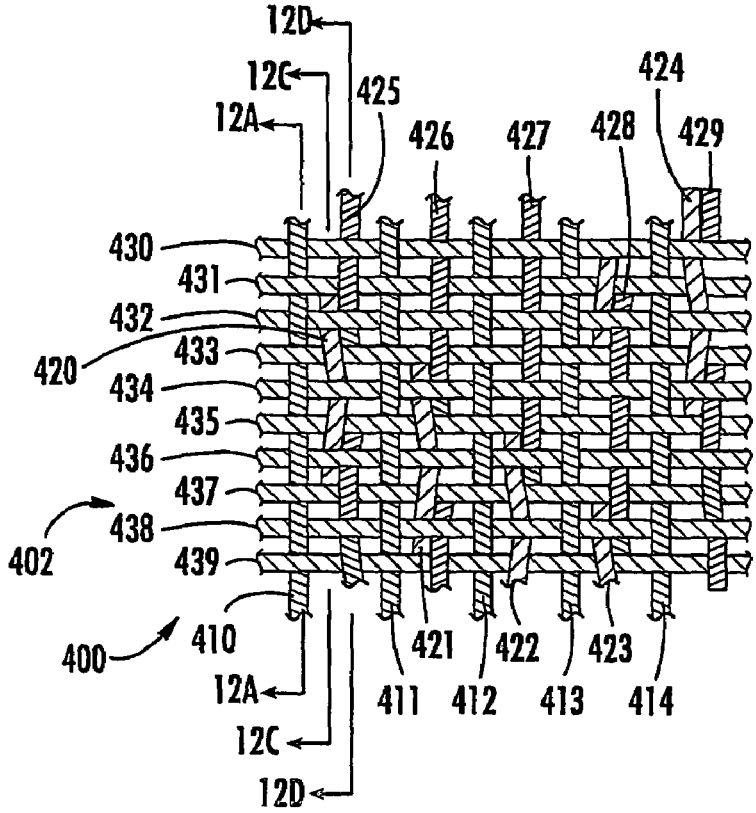
FIG. 10 is a top view of the top fabric layer of a 20 harness triple layer forming fabric of the present invention.
Figure 11:
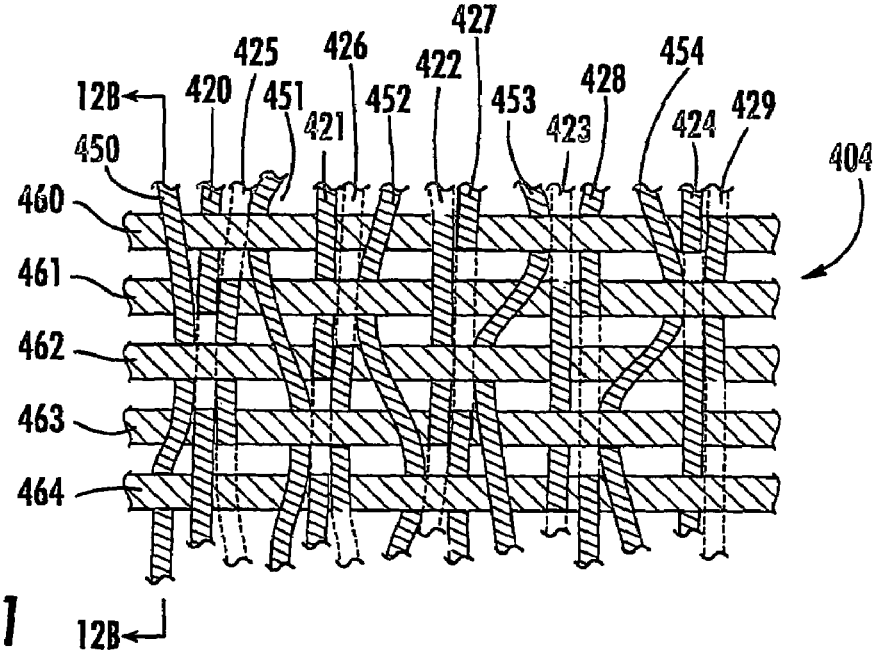
FIG. 11 is a top view of the bottom fabric layer of the triple layer forming fabric of FIG. 10.

The principles of the present invention can be extended to fabrics woven with different repeat patterns. For instance, a triple layer fabric 400 according to the present invention woven on 20 harnesses is depicted in FIGS. 10-12. FIG. 10 depicts a top view of the top fabric layer 402 of the triple layer fabric 400 (i.e., a view of the papermaking surface) while FIG. 11 depicts a top view of the bottom fabric layer 404 of fabric 400 (i.e., a view of the fabric 400 with the yarns that weave exclusively in the top fabric layer 402 removed). FIGS. 12A-12D depict the weave pattern of top MD yarn 410, bottom MD yarn 450, and stitching MD yarns 420 and 425, respectively. The triple layer fabric of FIGS. 10-12 is woven on twenty harnesses, and hence a single repeat of the fabric encompasses twenty machine direction yarns. While FIGS. 10 and 11 only show a single repeat unit of the fabric, those of skill in the art will appreciate that in commercial applications the depicted portion would be repeated many times, in both the machine and cross machine directions.

As seen in FIG. 10, the repeat unit of the top fabric layer 402 includes a set of top MD yarns 410-414 and a set of top CMD yarns 430-439 that are interwoven together. The top fabric layer further includes a set of five stitching MD yarn pairs 420, 425; 421, 426; 422, 427; 423, 428; 424, 429 that also interweave with the top CMD yarns 430-439. As shown in FIG. 10, a stitching MD yarn pair, such as for example, stitching MD yarn pair 420, 425, is provided between each pair of adjacent top MD yarns (e.g., yarns 410-411). Each stitching MD yarn pair (such as pair 420, 425) is woven such that while one of the yarns of the pair (e.g., yarn 420) weaves in the top fabric layer 402 to complete the weave pattern in the top fabric layer 402, the other of the stitching MD yarns (e.g., yarn 425) drops down into the bottom fabric layer 404 to bind the top fabric layer 402 and the bottom fabric layer 404 together. In this manner, the stitching MD yarn pairs 420, 425; 421, 426; 422, 427; 423, 428; 424, 429 both complete the weave of the top layer fabric 402 and also serve to bind the top and bottom fabric layers 402, 404 together. As further shown in FIG. 10, the yarns comprising the set of top CMD yarns 430-439 are interwoven with the set of top layer MD yarns 410-414 and the stitching MD yarn pairs 420, 425; 421, 426; 422, 427; 423, 428; 424, 429 in a plain weave pattern, meaning that each of the top CMD yarns 430-439 alternatively pass below one, and then above the next, of the machine direction yarns that at that point are weaving in the papermaking surface.

Referring now to FIG. 11, a repeat unit of the machine side surface of the bottom fabric layer 404 of the fabric 400 is shown. The repeat unit includes a set of bottom MD yarns 450-454 which are interwoven with a set of bottom CMD yarns 460-464. The repeat unit further includes the stitching MD yarn pairs 420, 425; 421, 426; 422, 427; 423, 428; 424, 429 which are described above.

As shown in FIG. 11, the bottom CMD yarns 460-464 of fabric 400 may be constructed using relatively large diameter yarns that are well suited to sustain the wear caused by papermaking machine during use of the fabric 400. As can also be seen in FIG. 11, the weave pattern of fabric 400 provides relatively long cross machine direction "floats" on the machine side surface.

Figure 12A:
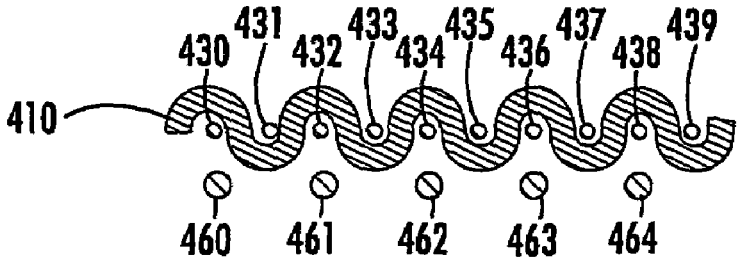
FIGS. 12A-12D are machine direction section views taken along the lines 12A-12A through 12D-12D of FIGS. 10 and 11.

FIGS. 12A-12D depict the individual machine direction yarn paths of representative machine direction yarns in the fabric 400. FIG. 12A depicts the machine direction yarn paths for top MD yarn 410. Top MD yarns 411-414 are woven in identical weave patterns. As shown in FIG. 12A, each of these top MD yarns 410-414 are woven in over-one/under-one patterns with the top CM yarns 430-439 (and each top MD yarn 410-414 passes over the exact same top CMD yarns 430, 432, 434, 436, 438) and do not weave with any yarns in the bottom fabric layer 404.

Figure 12B:
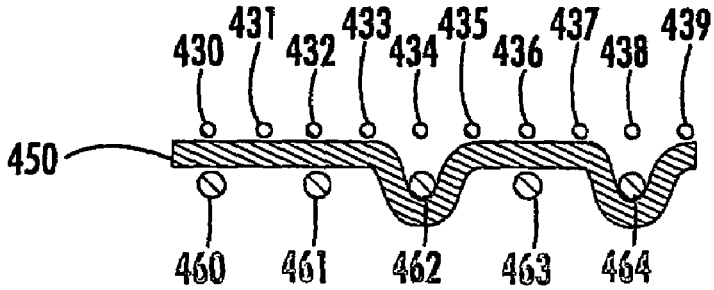

FIG. 12B depicts the machine direction yarn path of bottom MD yarn 450. As shown in FIG. 12B, bottom MD yarn 450 weaves with the bottom CMD yarns 460-464 in an over-two/under-one/over-one/under-one pattern—i.e., it passes over bottom CMD yarns 460-461, passes under bottom CMD yarn 462, passes over bottom CMD yarn 463 and passes under bottom CMD yarn 464 in each repeat of the fabric. The other bottom MD yarns 451-454 follow a similar "over-two/under-one/over-one/under-one pattern" weave pattern, although the starting point for the pattern is offset by one bottom CMD yarns 460-464 for each adjacent bottom MD yarn 450-454.

Figure 12C:
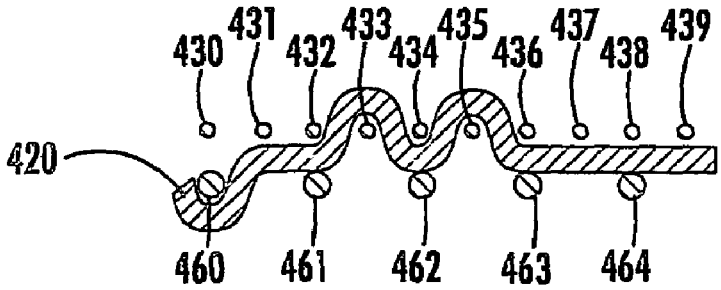

FIG. 12C depicts the machine direction yarn path of stitching MD yarn 420. As shown in FIG. 12C, stitching MD yarn 420 is woven in an under-one/over-four pattern with respect to the bottom CMD yarns 460-464, and is woven in a under-seven/over-one/under-one/over-one pattern with respect to the top CMD yarns 430-439. Stitching MD yarns 421-424 follow the same patterns with respect to the bottom CMD yarns 460-464 and the top CMD yarns 430-439 as stitching MD yarn 420, except that the starting point for the pattern is offset by one bottom CMD yarns 460-464 (and hence two top CMD yarns 430-439) for each adjacent stitching MD yarn 420-424.

Figure 12D:
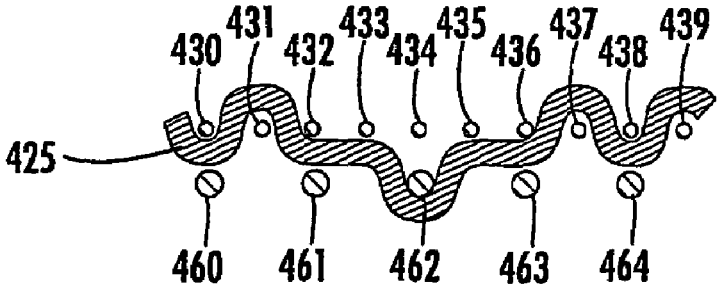

FIG. 12D depicts the machine direction yarn path of stitching MD yarn 425. As shown in FIG. 12D, stitching MD yarn 425 is woven in an over-four/under-one pattern with respect to the bottom CMD yarns 460-464, and is woven in a under-one/over-one/under-five/over-one/under-one/over-one pattern with respect to the top CML yarns 430-439. Stitching MD yarns 426-429 follow the same patterns with respect to the top CMD yarns 430-439 as stitching MD yarn 425, except that the starting point for the pattern is offset by one bottom CMD yarns 460-464 (and hence two top CMD yarns 430-439) for each adjacent stitching MD yarn 425-429.

Figure 13:
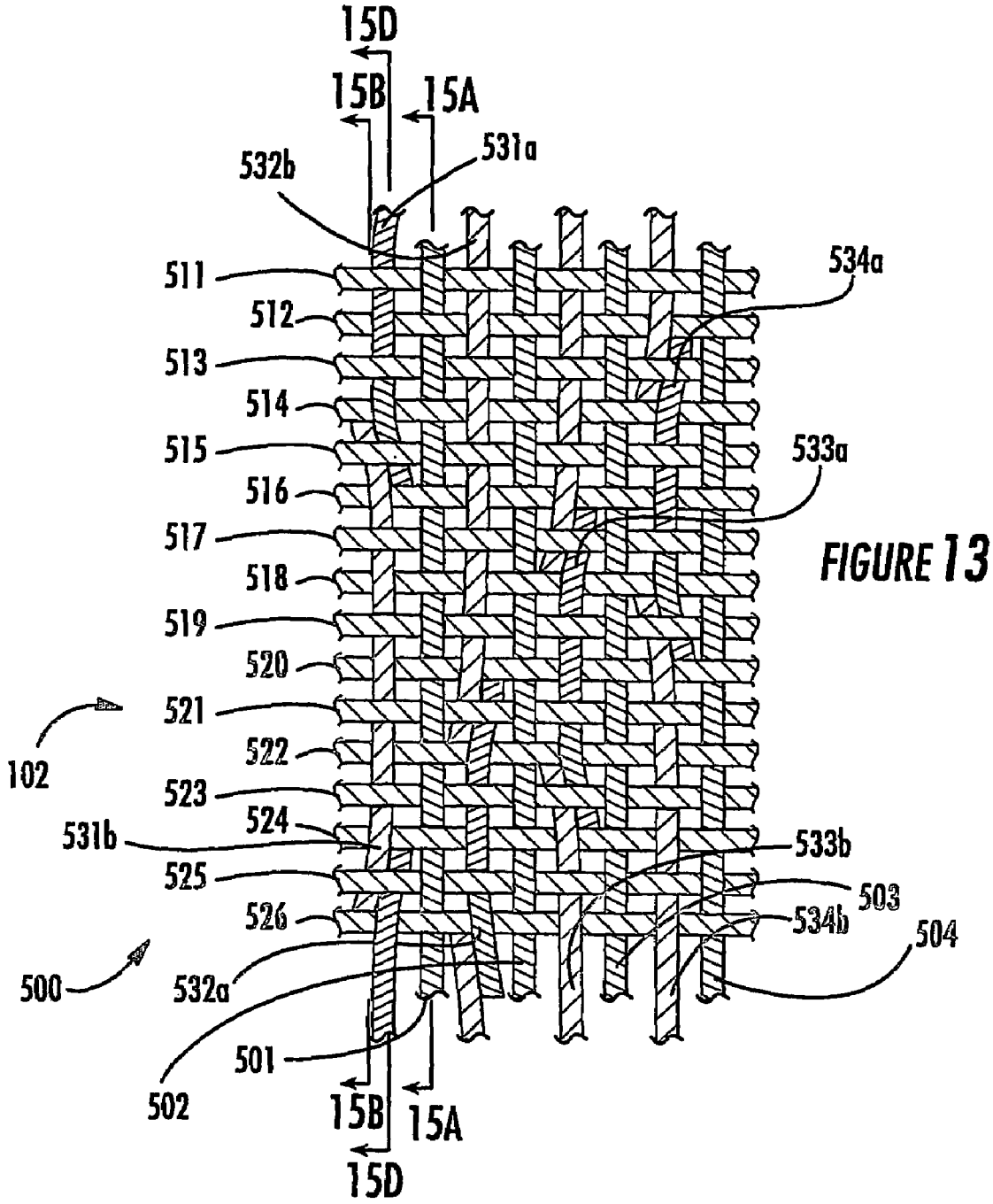
FIG. 13 is a top view of the top fabric layer of another embodiment of a 16 harness triple layer forming fabric of the present invention.
Figure 14:
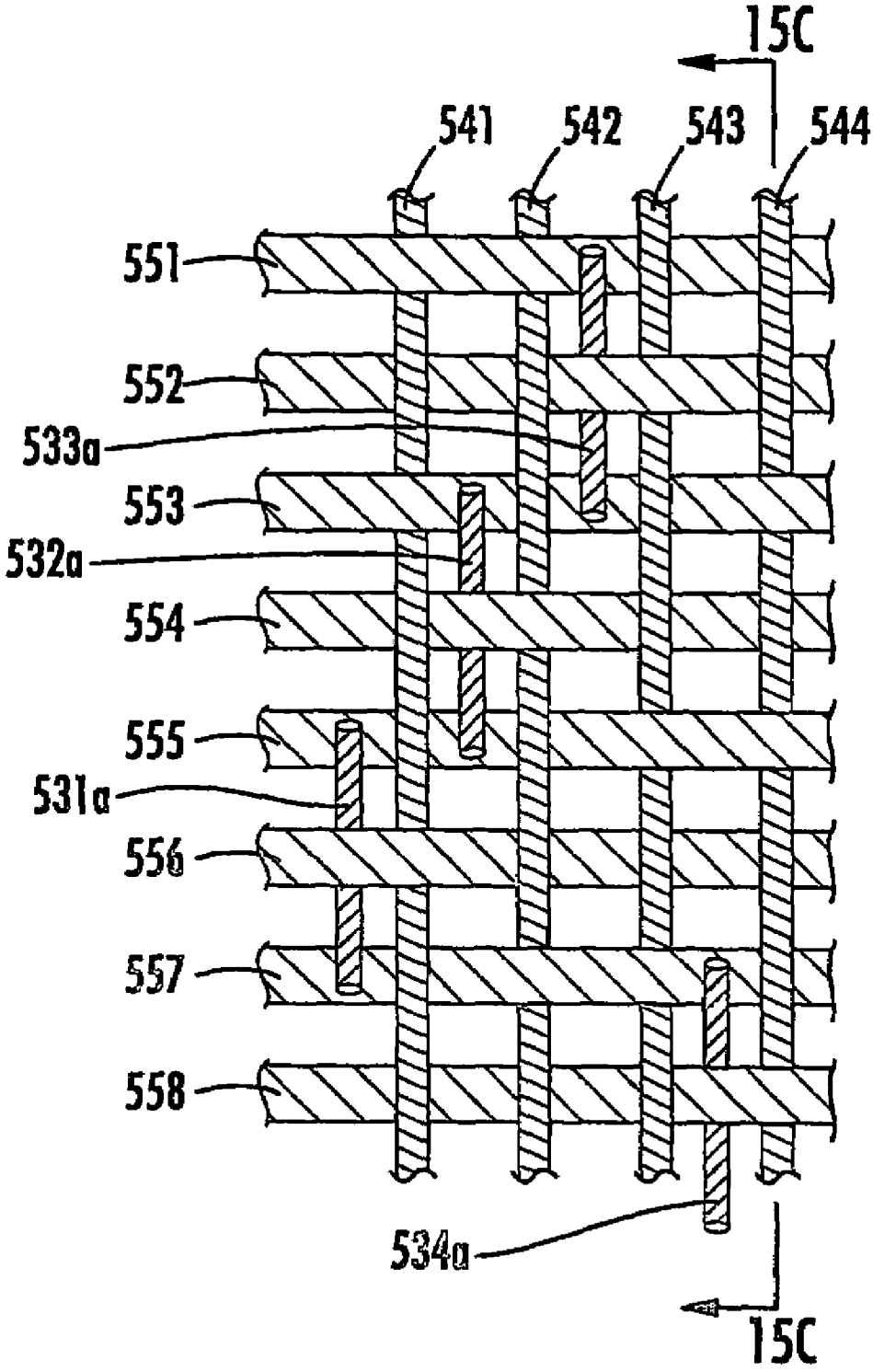
FIG. 14 is a top view of the bottom fabric layer of the triple layer forming fabric of FIG. 13.

Another sixteen harness triple layer fabric embodiment of the present invention is illustrated in FIGS. 13-15D and is designated broadly therein at 500. The fabric 500 (one repeat unit of which is illustrated in FIGS. 13 and 14) includes four top MD yarns 501-504, sixteen top CMD yarns 511-526, four bottom MD yarns 541-544, eight bottom CMD yarns 551-558, and four pairs of MD stitching yarns 531*a*-534*b*. These yarns are interwoven as described below.

Figure 15A:
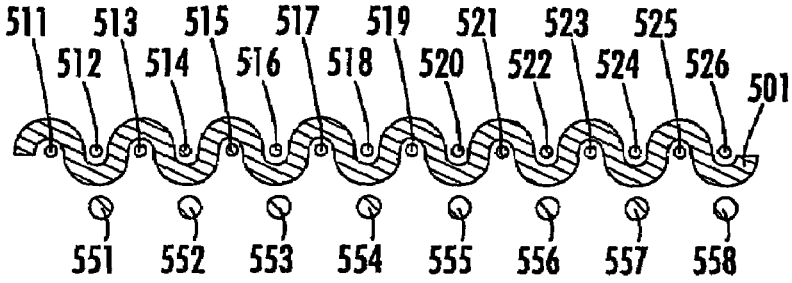
FIGS. 15A-15D are machine direction section views taken along the lines 15A-15A through 15D-15D of FIGS. 13 and 14.

The top layer of the fabric 500 is a plain weave surface formed by the interweaving of the top MD yarns 501-504, the top CMD yarns 511-526, and stitching portions of the stitching yarns 531*a*-534*b*. As shown in FIG. 15A, each top MD yarn 501-504 follows an "over 1/under 1" sequence in interweaving with the top CMD yarns 511-526. For example, top MD yarn 501 passes over top CMD yarn 511, under top CMD yarn 512, over top CMD yarn 513, and so on until it passes under top CMD yarn 526. Each of the other top MD yarns passes over and under the same top CMD yarns.

As is the case with the fabric 300 illustrated in FIG. 7, the stitching yarn pairs combine to act as a single yarn in completing the plain weave pattern on the top surface of the fabric 500. Each of the stitching yarns designated with an "a" passes over three top CMD yarns as part of the repeat unit, and each of the stitching yarns designated with a "b" passes over five top CMD yarns as part of the repeat unit. For example, stitching yarn 532*b* passes over top CMD yarns 512, 514, 516, 518 and 520, and its paired stitching yarn 532*a* passes over top CMD yarns 522, 524 and 526.

Top MD yarns 501-504 are each separated from one another by a stitching yarn pair. For example, stitching yarn pair 532*a*, 532*b* is positioned between top MD yarn 501, 502. Thus, as the top MD yarns 501, 502 both pass over top CMD yarn 511, the stitching yarn pair 532*b* passes under top CMD yarn 511, as the top MD yarns 501, 502*b* both pass under top CMD yarn 512, the stitching yarn 532*b* passes over top CMD yarn 512, and so on to form the plain weave top surface for the fabric 500.

Each pair of stitching yarns is offset from its neighboring stitching yarn pairs by four top CMD yarns. This can be seen by examination of FIG. 13, wherein stitching yarns 531*a*, 531*b* both pass below top CMD yarn 525 as they travel between the top and bottom layers of the fabric 500. Moving up FIG. 13 and to stitching yarns 532*a*, 532*b*, these yarns both pass below top CMD yarn 521 (which is offset from top CMD yarn 525 by four top CMD yarns) as they travel between the top and bottom layers.

The bottom layer of the fabric 500 is illustrated in FIGS. 14 and 15A-15D. Each of the bottom MD yarns is positioned beneath a top MD yarn, and each of the bottom CMD yarns is positioned beneath a top CMD yarn. Because there are eight bottom CMD yarns and sixteen top CMD yarns, every other top CMD yarn (for example, top CMd yarn 511) has no bottom CMD yarn beneath it. These relationships can be seen in FIGS. 15A-15D.

Referring still to FIG. 14, each of the bottom MD yarns 541-544 interweaves with the bottom CMD yarns 551-558 in an "over 2/under 1/over 1/under 1/over 2/under 1" sequence within the repeat unit. For example, bottom MD yarn 544 passes over bottom CMD yarns 551, 552, under bottom CMD yarn 553, over bottom CMD yarn 554, under bottom CMD yarn 555, over bottom CMD yarns 556, 557 and under bottom CMD yarn 558. Each bottom MD yarn is offset from its neighboring bottom MD yarns by two top bottom CMD yarns. For example, bottom MD yarn 542 forms its "over 1" segment over bottom CMD yarn 558, while neighboring bottom MD yarn 543 forms its "over 1" segment over bottom CMD yarn 556.

Figure 15B:
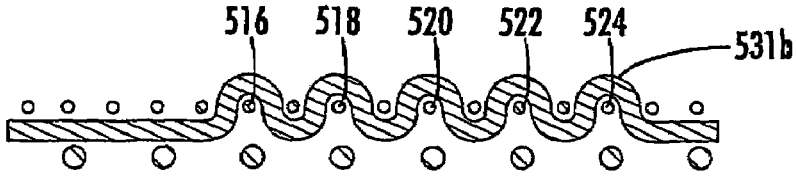
Figure 15C:
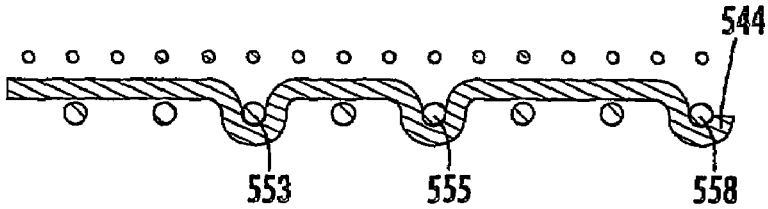
Figure 15D:
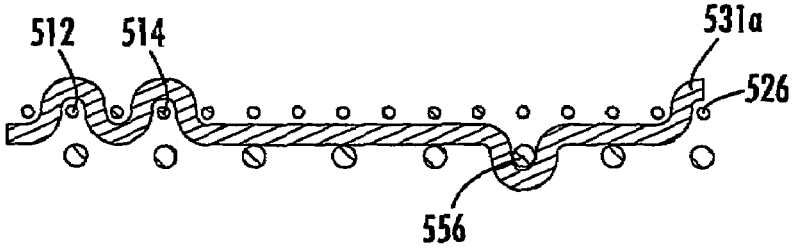

Referring now to FIGS. 14, 15B and 15D, as described above, when a stitching yarn of a pair is not interweaving with top CMD yarns, it passes below the top CMD yarns. In this embodiment, like the embodiment of FIGS. 4-6D, one of the stitching yarns of each stitching yarn pair does not interlace with a bottom CMD yarn, but instead floats above it. More specifically, each of the "a" stitching yarns interlaces with a bottom CMD yarn, while each of the "b" stitching yarns does not.

For example, as shown in FIGS. 14, 15B and 15D, stitching yarn 531*a* stitches below bottom CMD yarn 556, but its paired stitching yarn 531*b* does not stitch with any of the bottom CMD yarns. The stitching locations for the "a" stitching yarns are offset from one another by two bottom CMD yarns; for example, stitching yarn 531*a* stitches below bottom CMD yarn 556, and stitching yarn 532*a* stitches below bottom CMD yarn 554.

In the illustrated embodiment, the stitches formed by the "a" stitching yarns are positioned adjacent a bottom side knuckle formed by a neighboring MD yarn. As an example, stitching yarn 531*a* stitches under bottom CMD yarn 556. Neighboring bottom MD yarn 541 also forms a bottom side knuckle below bottom CMD yarn 556.

In this configuration, the bottom side MD yarn knuckle can help to protect the stitching knuckle from wear caused by contact with a paper machine during use. It can also be seen that, for every other bottom CMD yarn, the bottom MD yarns forming knuckles below it are adjacent to one another. For example, adjacent bottom MD yarns 541, 542 form knuckles below bottom CMD yarn 551, adjacent bottom MD yarns 544, 541 form knuckles below bottom CMD yarn 553, and so on for bottom CMD yarns 555 and 557.

This sixteen harness embodiment may be less susceptible to diagonal marking than other fabrics, and in particular other MD-stitched fabrics. The potential improvement in diagonal marking performance may be attributed to multiple factors, including the absence of interweaving between the "b" stitching yarns and the bottom CMD yarns, and reduced crimping of the "a" yarns.

Figure 16:
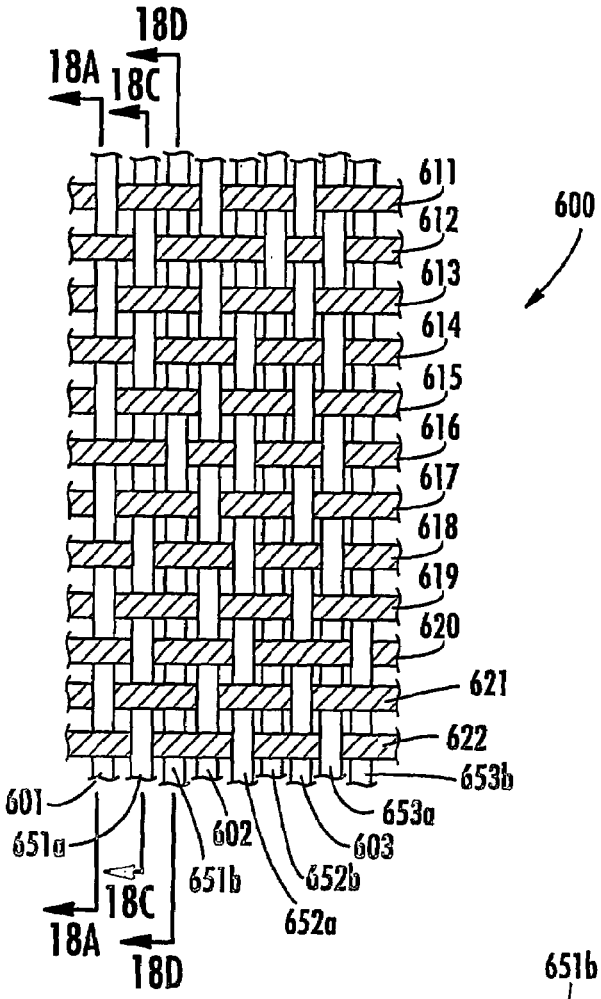
FIG. 16 is a top view of the top fabric layer of another embodiment of a 12 harness triple layer forming fabric of the present invention.
Figure 17:
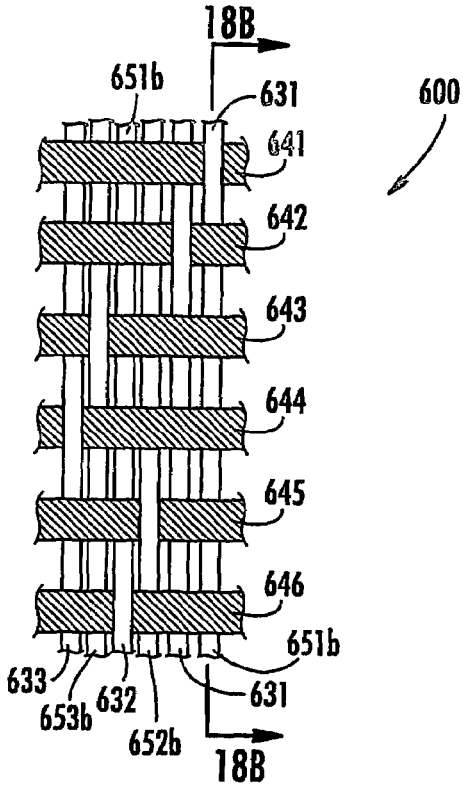
FIG. 17 is a bottom view of the bottom fabric layer of the triple layer forming fabric of FIG. 16.
Figure 18A:
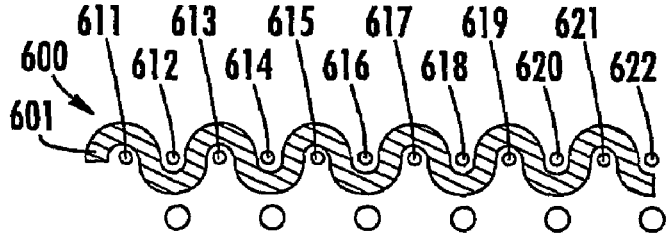
FIGS. 18A-18D are machine direction section views taken along the lines 18A-18A through 18D-18D of FIGS. 16 and 17.
Figure 18B:
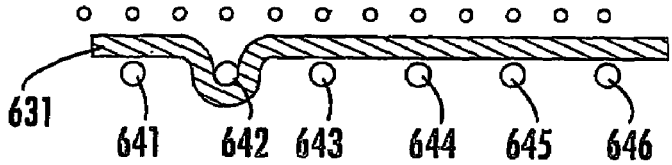
Figure 18C:
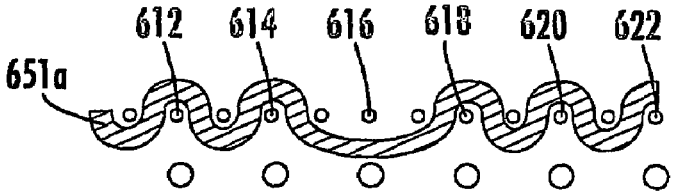
Figure 18D:
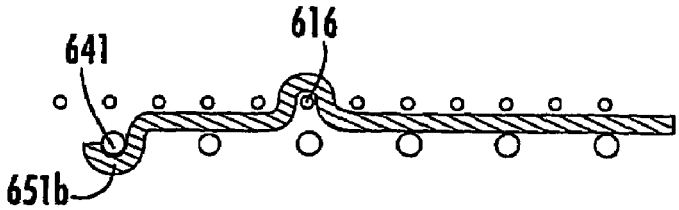
Figure 19:
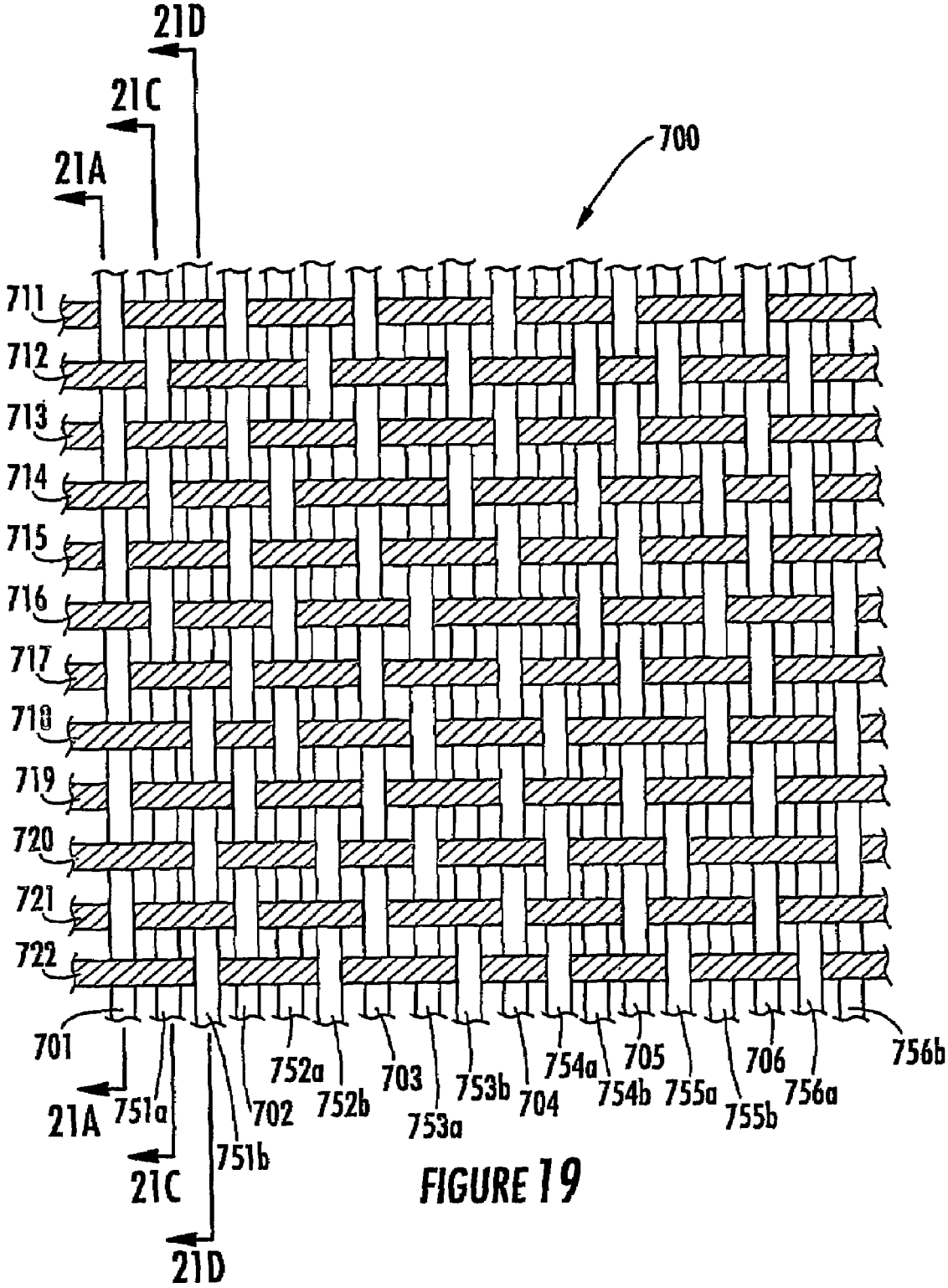
FIG. 19 is a top view of the top fabric layer of another embodiment of a 24 harness triple layer forming fabric of the present invention.

FIGS. 16 and 17 illustrate a twelve harness fabric 600 that represents embodiments of the present invention. A repeat unit of the fabric 600 includes three top MD yarns 601-603, twelve top CMD yarns 611-622, three bottom MD yarns 631-633, three bottom CMD yarns 641-643, and three stitching yarn pairs 651*a*, 651*b*-653*a*, 653*b*. The weave pattern of these yarns is discussed below.

Turning first to FIGS. 16 and 18A-D, each of the top MD yarns 601-603 is interwoven with alternating top CMD yarns 611-622 in an "over 1/under 1" sequence, with each top MD yarn 601-603 passing over the same top CMD yarns. Thus, top MD yarn 601 passes over top CMD yarn 611, under top CM yarn 612, over top CMD yarn 613, and so on throughout the pattern.

Each of the stitching yarn pairs 651*a*, 651*b*-653*a*, 653*b* includes an "a" stitching yarn that weaves with the top CMD yarns 611-622 in an "over 1/under 1" sequence with the exception of one segment that passes under three top CMD yarns. For example, stitching yarn 651*a* passes below top CMD yarn 611, above top CMD yarn 612, below top CMD yarn 613, above top CMD yarn 614, below top CMD yarns 615-617, above top CMD yarn 618, below top CMD yarn 619, above top CMD yarn 620, below top CMD yarn 621, and above top CMD yarn 622. The "b" stitching yarn of each pair passes below all of the top CMD yarns with the exception of the CMD yarn that defines the center of the three yarn segment of the paired "a" stitching yarn. As an example, stitching yarn 651*b* passes above only top CMD yarn 616, which is in the center of the three yarn segment of stitching yarn 651*a* that passes below top CMD yarns 615-617. In this manner, together stitching yarns 651*a*, 651*b* effectively form a top CMD yarn that has an "over 1/under 1" sequence. Because the top surface knuckles of the stitching yarn pairs are offset from the top knuckles of the top MD yarns by one top CMD yarn, the top MD yarns and stitching yarn pairs form a plain weave surface on the top surface of the fabric 600. It should be noted that the top surface knuckles formed by the "b" yarns are offset from adjacent "b" yarn top surface knuckles by four top CMD yarns.

Turning now to FIG. 17, which illustrates the bottom surface of the fabric 600, and to FIGS. 18A-18D, each of the bottom MD yarns 631-636 interweaves with the bottom CMD yarns 641-646 in an "over 1/under 5" sequence (it should be understood that "over" and "under" as used herein refer to a fabric in which the bottom surface illustrated in FIG. 17 is facing downwardly). As an example, bottom MD yarn 632 passes above bottom CMD yarns 641-645, then below bottom CMD yarn 646. Adjacent bottom MD yarns are offset from one another by two bottom CMD yarns; thus, bottom MD yarn 632 passes below (therefore forming a bottom side knuckle under) bottom CMD yarn 644, which is offset from bottom CMD yarn 636 (which bottom MD yarn 631 passes below) by two bottom CMD yarns.

The "b" stitching yarns also pass below one bottom CMD yarn. More specifically, the "b" stitching yarns pass below a bottom CMD yarn that is positioned directly below a top CMD yarn that is offset from the top CMD yarn over which the "b" yarn passes by five top CMD yarns. As an example, stitching yarn 651*b* passes above top CMD yarn 616 and below bottom CMD yarn 641, which is located beneath top CMD yarn 612. Adjacent "b" stitching yarns are offset from each other by two bottom CMD yarns. Also, the bottom side knuckles formed by the "b" stitching yarns are offset from one adjacent bottom MD yarn by one bottom CMD yarn and from the other adjacent bottom CMD yarn by three bottom CMD yarns.

Embodiments of twelve harness versions of fabrics of the present invention may have improved life and lower caliper than other similar fabrics.

FIGS. 19, 20 and 21A-D illustrate a 24 harness embodiment of the present invention, designated broadly at 700. A repeat unit of the fabric 700 includes six top MD yarns 701-706, twelve top CML yarns 711-722, six bottom MD yarns 731-736, six bottom CMD yarns 741-746, and six stitching yarn pairs 751*a*, 751*b*-756*a*, 756*b*. These are interwoven as described below.

Turning first to FIGS. 19 and 21A-D, each of the top MD yarns 701-706 is interwoven with alternating top CMD yarns 711-722 in an "over 1/under 1" sequence, with each top MD yarn 701-706 passing over the same top CMD yarns. Thus, top MD yarn 701 passes over top CMD yarn 701, under top CMD yarn 702, over top CMD yarn 703, and so on throughout the pattern.

The stitching yarn pairs 751*a*, 751*b*-756*a*, 756*b* combine to act as a single yarn in completing the plain weave pattern on the top surface of the fabric 700. Each of the stitching yarns forms three top surface knuckles in passing over top CMD yarns; together, they form six top surface knuckles that are formed over the top CMD yarns that are passed under by the top MD yarns 701-706. For example, stitching yarn 751*a* passes over top CMD yarns 702, 704, 706 and stitching yarn 751*b* passes over top CMD yarns 708, 710, 712, thereby forming an entire "effective" top MD yarn. (Those stitching yarns designated with an "a" are woven immediately adjacent a top MD yarn to their left (from the vantage point of FIG. 19), and those stitching yarns designated with a "b" are woven such that the other stitching yarn of the pair is positioned between it and the top MD yarn immediately adjacent on the left in FIG. 19). Together the top MD yarns 701-706, the top CMD yarns 711-722 and these upper portions of the stitching yarns 751*a*-756*b* form a plain weave surface on the top surface of the fabric 700.

Figure 20:
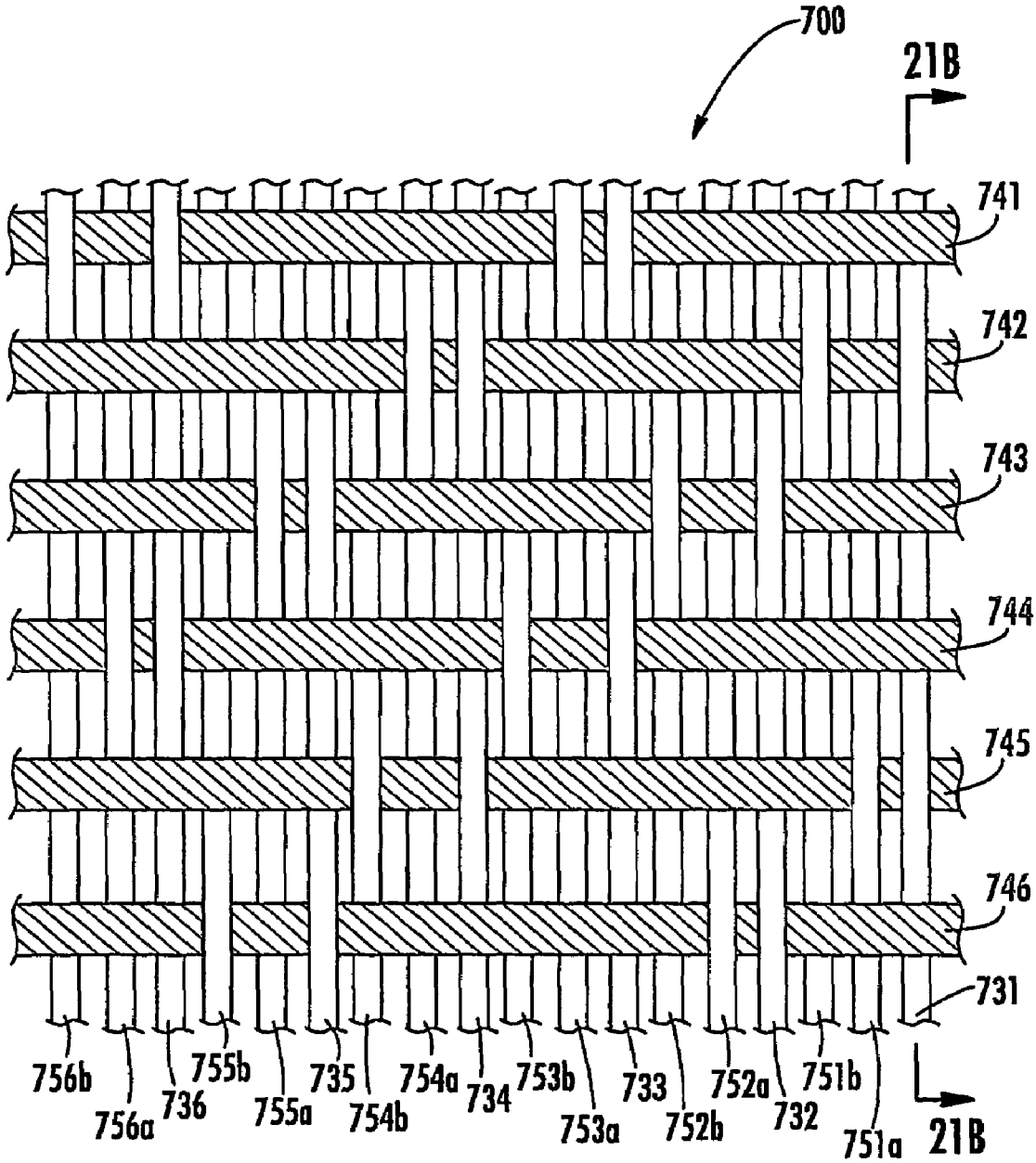
FIG. 20 is a bottom view of the bottom fabric layer of the triple layer forming fabric of FIG. 19.
Figure 21A:
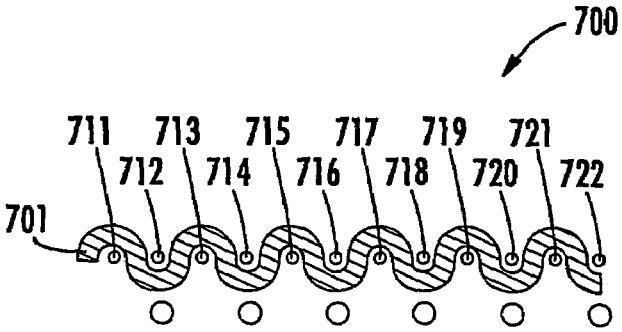
FIGS. 21A-21D are machine direction section views taken along the lines 21A-21A through 21D-21D of FIGS. 19 and 20.
Figure 21B:
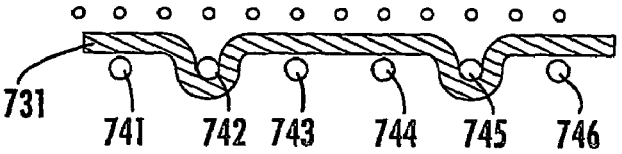
Figure 21C:
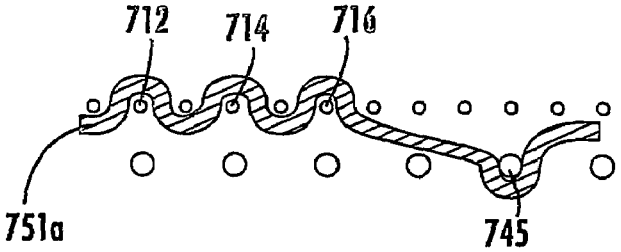
Figure 21D:
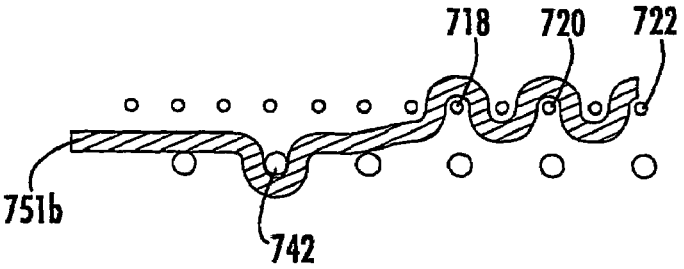

Turning now to FIG. 20, which illustrates the bottom surface of the fabric 700, and to FIGS. 21A-D, each of the bottom MD yarns 731-736 interweaves with the bottom CMD yarns 741-746 in an "over 2/under 1" sequence (it should be understood that "over" and "under" as used herein refer to a fabric in which the bottom surface illustrated in FIG. 20 is facing downwardly). For example, bottom MD yarn 732 weaves above bottom CMD yarns 741, 742, below bottom CMD yarn 743, above bottom CMD yarns 744 and 745, and below bottom CMD yarn 746. Adjacent bottom MD yarns are offset from each other by one bottom CMD yarn.

Still referring to FIGS. 20 and 21A-D, the lower portions of each stitching yarn 751*a*-756*b* stitch below one bottom CMD yarn, with the stitching locations of the stitching yarns within a stitching yarn pair being offset by three bottom CMD yarns. This results in the lower portions of the stitching yarns forming an "effective" bottom MD yarn. For example, stitching yarns 751*a*, 751*b* stitch below, respectively, bottom CMD yarns 745 and 742. Each of these stitching locations is immediately adjacent a bottom surface knuckle formed by one of the adjacent bottom MD yarns. As a result, bottom side knuckle pairs are formed by one bottom MD yarn and one stitching yarn. For example, both bottom MD yarn 741 and stitching yarn 752*a* form bottom surface knuckles below bottom CMD yarn 746.

The stitching yarns 751*a*-756*b* are woven as "reversed" MD yarns in the illustrated embodiment, in that the knuckle positions for stitching yarn pairs that form top surface knuckles over the same top CMD yarns are reversed between the "a" yarns and the "b" yarns. For example, stitching yarn 751*b* forms knuckles over top CMD yarns 708, 7010, 712, and stitching yarn 751*a* forms knuckles over top CMD yarns 702, 704, 706. The next pair of stitching yarns that forms knuckles over these same subsets of top CMD yarns, namely stitching yarns 754*a*, 754*b*, is reversed; i.e., it is the "b" yarn (754*b*) that forms knuckles over top CMD yarns 702, 704, 706 and it is the "a" yarn (754*a*) that forms knuckles over top CMD yarns 708, 710, 712. This configuration is optional (and not employing it would reduce the size of the repeat unit of the fabric to three top MD yarns, three bottom MD yarns, and three stitching yarn pairs), but has shown to improve marking performance in some embodiments of the fabric.

FIGS. 22, 23 and 24A-D illustrate a fabric 800 that demonstrates that fabrics can be MD stitched with stitching pairs that appear less frequently in the repeat unit than the fabrics discussed above. A repeat unit of the fabric 800 includes three top MD yarns 801-803, twelve top CMD yarns 811-822, three bottom MD yarns 831-833, eight bottom CMD yarns 841-848, and a stitching yarn pair 851*a*, 851*b*. These yarns are interwoven as described below.

Figure 22:
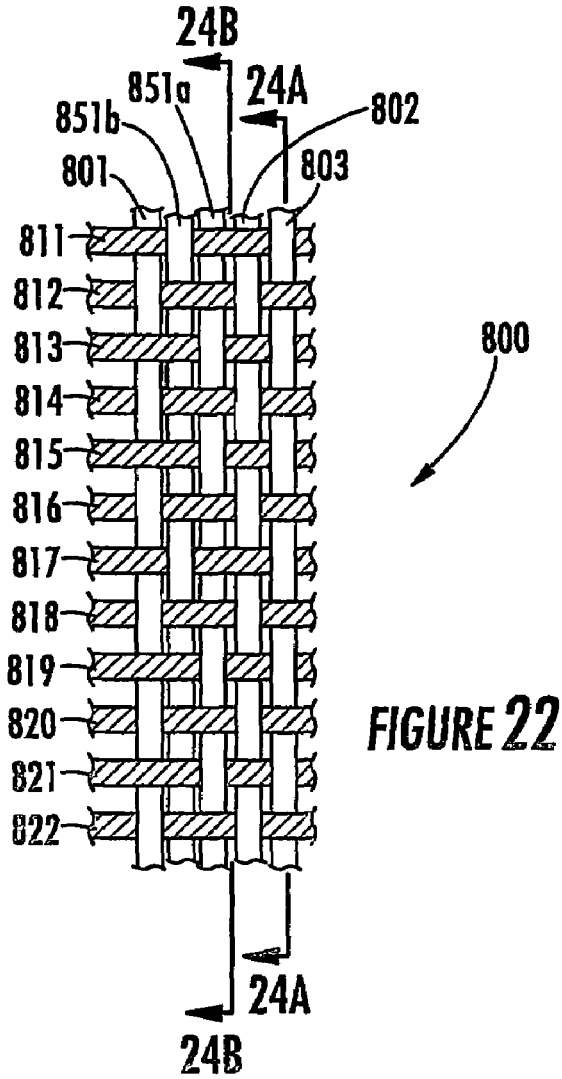
FIG. 22 is a top view of the top fabric layer of another embodiment of an 8 harness triple layer forming fabric of the present invention.
Figure 24A:
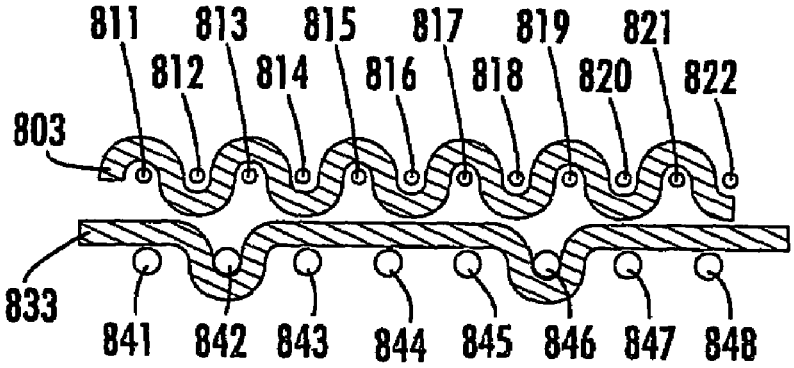
FIGS. 24A-24B are machine direction section views taken along the lines 24A-24A through 24D-24D of FIGS. 22 and 23.
Figure 24B:
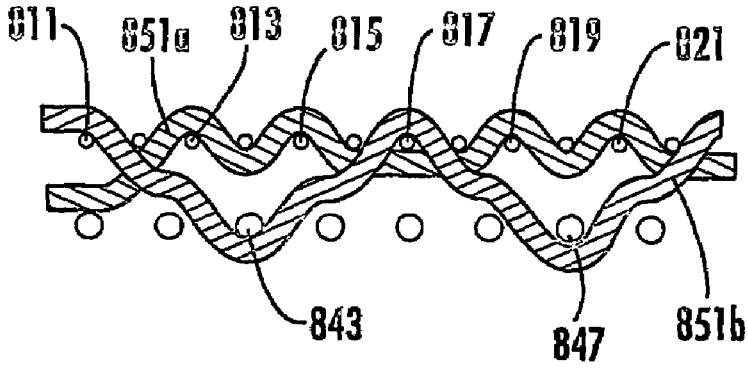

Turning first to FIGS. 22 and 24A-B, each of the top MD yarns 801-803 is interwoven with the top CMD yarns 811-822 in an "over 1/under 1" pattern. The top MD yarn 803 is offset from the top MD yarns 801 and 802 by one top CMD yarn to form a plain weave pattern. This pattern is completed by the stitching yarn pair 851*a*, 851*b*. Stitching yarn 851*a* follows an "over 1/under 1/over 1/under 3" sequence that is repeated twice in the repeat unit. More specifically, stitching yarn 851*a* passes over top CMD yarns 813 and 815, then passes below top CMD yarns 816-818 before passing above top CMD yarn 819 to recommence the sequence. Stitching yarn 851*b* passes over one top CMD yarn (CMD yarn 817) to complete the plain weave top surface.

Figure 23:
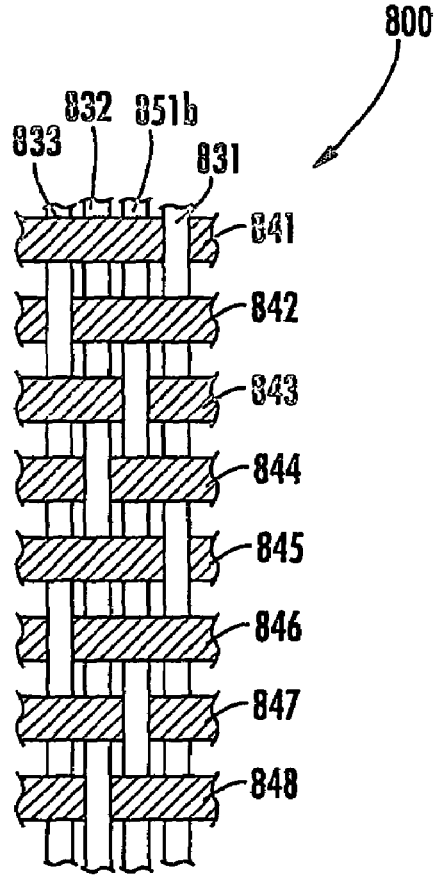
FIG. 23 is a bottom view of the bottom fabric layer of the triple layer forming fabric of FIG. 22.

Turning now to FIGS. 23 and 24A-B, each bottom MD yarn 831-833 is located below a corresponding top MD yarn and interweaves in an "over 3/under 1" sequence with the bottom CMD yarns 841-848. The stitching yarn 851*b* also stitches in an "over 3/under 1" sequence, but, as noted above, in its "over 3" segment the stitching yarn 851*b* also passes over a top CMD yarn. The bottom MD yarns 831-833 and the stitching yarn 851*b* are offset from each other such that the knuckles in the bottom surface of the fabric 800 form a broken twill pattern.

The fabric 800 may exhibit increased life over similar forming fabrics. In addition, the fabric 800 may be prone to less edge curl, and have lower void volume, than similar fabrics. It should be understood that, although the fabric 800 has a 3:1 ratio of top MD yarns to stitching yarn pairs, other ratios, (such as 2:1 or 3:2) may also be employed.

A further fabric embodiment, designated broadly at 900 in FIGS. 25, 26 and 27A-D, demonstrates that the MD stitching concept may be employed with triple layer fabrics that do not have plain weave surfaces. A repeat unit of the fabric 900 includes four top MD yarns 901-904, eight top CMD yarns 911-918, two bottom MD yarns 921, 922, four bottom CMD yarns 931-934, and two stitching yarns 941, 942. These are interwoven as described below.

Figure 25:
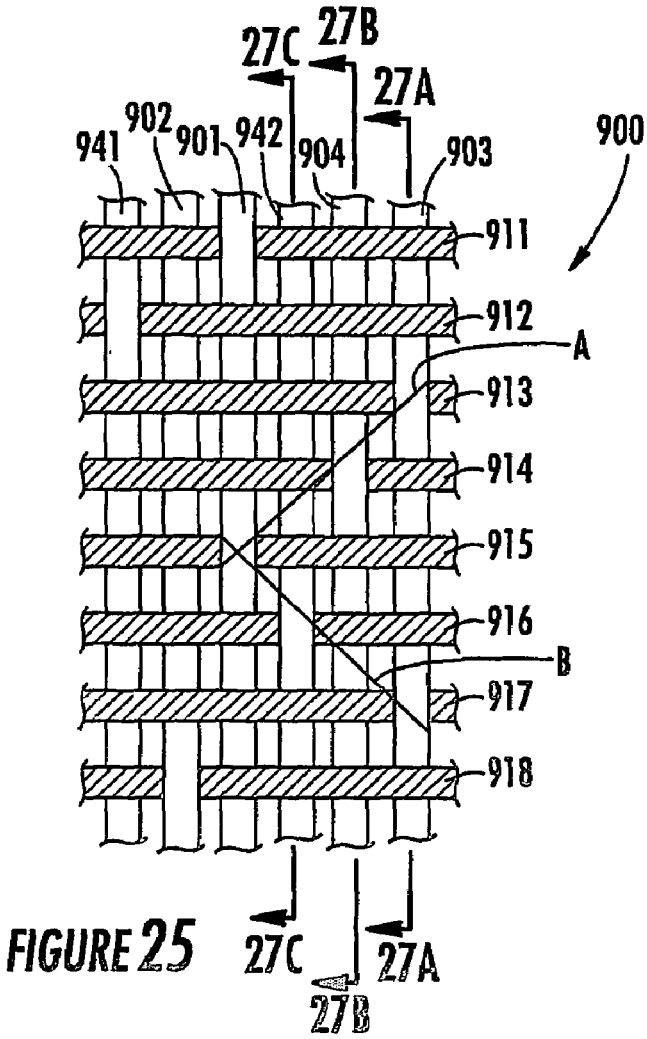
FIG. 25 is a top view of the top fabric layer of another embodiment of an eight harness triple layer forming fabric of the present invention.
Figure 26:
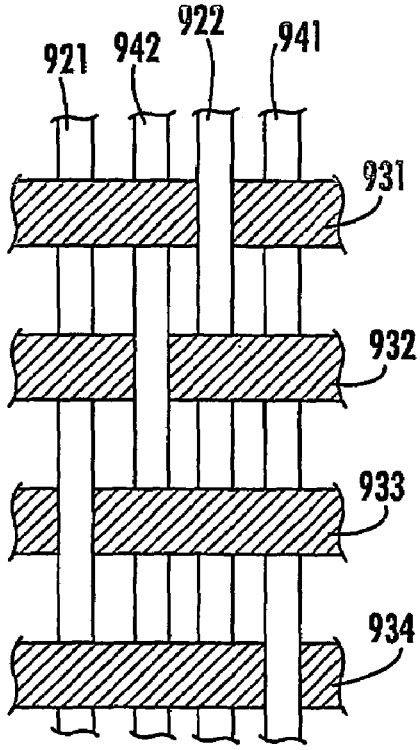
FIG. 26 is a bottom view of the bottom fabric layer of the triple layer forming fabric of FIG. 16.
Figure 27A:
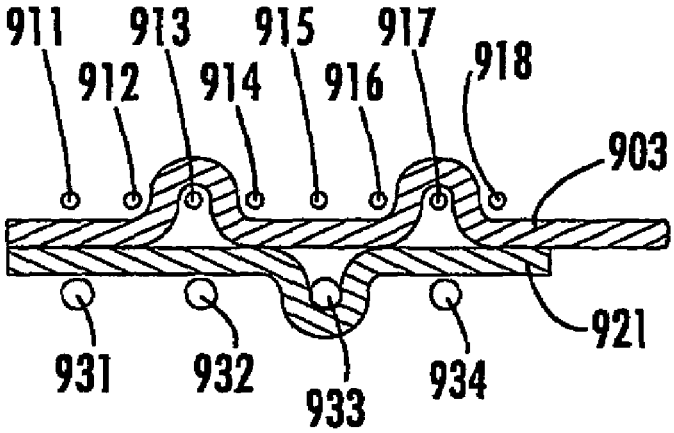
FIGS. 27A-27C are machine direction section views taken along the lines 27A-27A through 27C-27C of FIGS. 25 and 26.
Figure 27B:
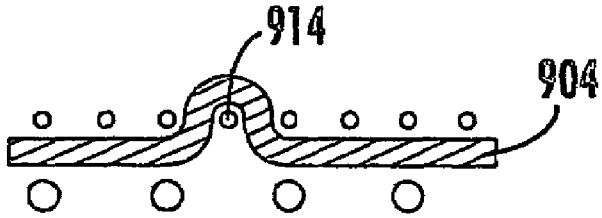
Figure 27C:
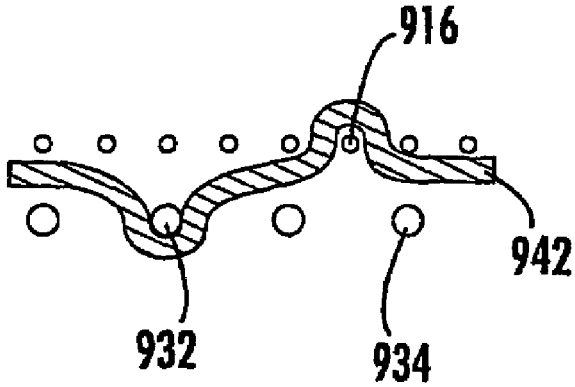

Turning first to FIG. 25, which illustrates the top surface of the fabric 900, the top MD yarns can be divided into two subsets: one that includes two top MD yarns 901, 903 that follow an "under 3/over 1" sequence with respect to the top CMD yarns 911-918; and one that includes two top MD yarns 902, 904 that follow an "under 7/over 1" sequence with respect to the top CMD yarns 911-918. The remainder of the top surface of the fabric 900 is formed by the stitching yarns 941, 942, each of which interweaves in an "over 1/under 7" sequence with the top CMD yarns 911-918.

The top MD yarns 901, 903 of the first set are offset from one another by two top CMD yarns. Each of the knuckles formed by the MD yarns 902, 904 of the second set is located on a diagonal line A defined between two of the knuckles of the top MD yarns 901, 903. The knuckles formed by the stitching yarns 941, 942 are positioned along an opposite diagonal line B formed between the same knuckle of the top MD yarn 903 and the next adjacent knuckle of the top MD yarn 901. The result is a general herringbone pattern of knuckles on the top surface of the fabric 900.

The bottom surface of the fabric 900 (see FIGS. 26 and 27A-D) is formed by the interweaving of the bottom MD yarns 921, 922 with the bottom CMD yarns 931-934 in an "over 3/under 1" pattern, and by the stitching of the stitching yarns 941, 942 in a similar "over 3/under 1" pattern. The bottom surface knuckles formed by the bottom MD yarns 921, 922 and the stitching yarns 941, 942 are offset from each other by one bottom CMD yarn such that the bottom MD knuckles form a relatively distinct diagonal on the bottom surface of the fabric 900.

The fabric 900, with its herringbone pattern on the top surface, may be particularly suitable for the formation of tissue paper. This fabric also helps to demonstrate that patterns other than the plain weave top surface of the other fabrics illustrated above may be suitable for use with the present invention.

The present invention is directed to "true" triple layer fabrics—meaning triple layer fabrics that include (1) a set of MD yarns and a set of CMD yarns that each weave exclusively in a top fabric layer and (2) a set of MD yarns and a set of CMD yarns that each weave exclusively in a bottom fabric layer—that are stitched together by machine direction yarns. Such machine direction yarn stitched true triple layer fabrics may typically be manufactured less expensively than most high-performance cross machine direction yarn triple layer fabrics while providing improved fiber support (with the plain weave top surface) compared to conventional double layer fabrics. Pursuant to the teachings of the present invention, it will be appreciated that the machine direction yarn stitched true triple layer fabrics may have improved stacking of the machine direction yarns, increased permeability and higher void volumes as compared to double layer fabrics. Additionally, by using yarn pairs that complete the weave in the papermaking surface as the stitching yarns it is possible to bind the fabric together at numerous locations, thereby providing a very stable fabric that is not particularly susceptible to interlayer wear.

Each of the fabrics 100, 200, 300, 400, 500, 600, 700, 800, 900 depicted in the figures includes MD stitching yarn pairs in which the yarns that comprise the pair interlace with the top fabric layer an unequal number of times in each repeat of the fabric. For example, as shown best in FIGS. 3B and 3C, each stitching MD yarn pair 120, 124; 121, 125; 122, 126; 123, 127 of fabric 100 include a stitching MD yarn (e.g., yarn 120) that interlaces with the top fabric layer 102 five time per repeat and a stitching MD yarn (e.g., yarn 124) that interlaces with the top fabric layer 102 three times per repeat unit of the fabric. This "unequal interlacing" configuration may provide improved fabric uniformity—particularly on the top surface. As will be appreciated by those of skill in the art, when the fabric is woven off two warp beams, the crimp of the warp yarns woven off each beam will be different. Thus, by weaving the top MD yarns off the same warp as the stitching MD yarns that interlace the greater number of times in the top fabric layer, it may be possible to provide for a more uniform papermaking surface.

Those of skill in the art will appreciate that numerous modifications can be made to the above described fabrics. By way of example, the stitching MD yarn pairs can have a wide variety of weave patterns in terms which they complete the weave of the top fabric layer. Thus, the number of top MD yarns that each stitching MD yarn passes over to complete the plain weave pattern on the papermaking surface may vary, as may the frequency with which the yarns pass in and out of the top fabric layer. Additionally, a variety of different weave patterns may be employed in the top fabric layer, specifically including 1×2 twill, 2×2 twill, 1×3 twill and 1×4 twill papermaking surfaces, as well as various derivatives of the above-mentioned weave patterns, specifically including broken twill patterns such as those embodied in 4 or 5 harness satin single layer fabrics, which are known in the art as providing a good papermaking surface. Likewise, the frequency of the stitch points and/or the ratio of top-to-bottom machine direction and/or cross machine direction yarns may be varied. Thus, the scope of the present invention should be construed based on the claims appended hereto, as opposed to the illustrative examples of the claimed fabrics which are provided herein to fully enable those of skill in the art to practice the claimed invention.

Another exemplary modification would be to alternate for each adjacent stitching MD yarn pair the warp beam from which the stitching MD yarns are woven. For example, the fabric of FIGS. 1-3 could be modified so that stitching MD yarns 120, 125, 122, 127 are woven off the same warp beam as top MD yarns 110-113 and stitching MD yarns 124, 121, 126, 123 are woven off the same warp beam as bottom MD yarns 150-153 to effect this modification. This reversal of the stitching yarn positions may reduce any diagonal pattern in the fabric and hence improve fabric performance.

Those of skill in the art will likewise appreciate that the stitching MD yarn pairs need not be included between every adjacent pair of top MD yarns. Instead, a stitching MD yarn pair may be provided after every second, third, fourth or fifth top MD yarn. Those of skill in the art will also appreciate that the frequency of interlacing can be varied from that shown in the fabrics pictured herein. However, the stitching MD yarns should sufficiently bind the upper and lower fabric layers together to prevent excessive movement between the fabric layers, as such excessive movement could result in severe inter-layer wear problems.

Yet another exemplary modification would be to shift the positions of the top fabric layer and the bottom fabric layer of the depicted embodiments (or other embodiments) relative to each other. For example, in the fabric 100 of FIGS. 1-3, the position of the top fabric layer 102 with respect to the bottom fabric layer 104 might be shifted by one top CMD yarn.

Pursuant to another aspect of the present invention, the size and or stiffness of selected of the top CMD yarns may be varied to improve fabric performance. As illustrated best in FIG. 1, the papermaking surface of certain fabrics made according to the present invention include "transition points" where one of the stitching MD yarns in a stitching MD yarn pair completes its run on the papermaking surface and dives down into the center of the fabric while the second yarn of the stitching MD yarn pair emerges from the center of the fabric to start its run on the papermaking surface. An example of such a transition point is the point where stitching MD yarns 120 and 124 pass under top CMD yarn 140 in FIG. 1. At these transition points the yarns of the stitching MD yarn pair enter or exit the fabric at a steeper angle as the yarns dive down to, or emerge from, a portion of their run where they weave with the bottom fabric layer 104. This steeper angle may decrease the crimp on the stitching MD yarns at the position where they pass over the last top CMD yarn adjacent to the transition point—i.e., where stitching MD yarn 120 passes over top CMD yarn 139 and where stitching MD yarn 124 passes over top CMD yarn 141—as the stitching MD yarn exerts sufficient force on the top CMD yarn to pull the top CMD yarn slightly farther into the middle of the fabric at this point. Pursuant to the teachings of the present invention, it will be understood that this reduction in the crimp of the stitching MD yarn knuckles adjacent the transition points can be reduced or eliminated by using slightly larger diameter top CMD yarns for the top CMD yarns that bracket each transition point. In the fabric of FIG. 1, this would mean making top CMD yarns 131, 133, 135, 137, 139, 141, 143, 145 slightly larger than top CMD yarns 130, 132, 134, 136, 138, 140, 142, 144. For example, if top CMD yarns 130, 132, 134, 136, 138, 140, 142, 144 are 0.15 millimeters in diameter, then top CMD yarns 131, 133, 135, 137, 139, 141, 143, 145 may be made 0.17 millimeters in diameter. Instead of modifying the diameter of top CMD yarns 131, 133, 135, 137, 139, 141, 143, 145, one may alternatively use stiffer yarns (i.e., yarns having a higher elastic modulus, such as an elastic modulus that is 50% higher) that will more effectively resist the tendency to be pulled into the fabric adjacent the transition points.

The use of larger diameter and/or higher modulus top CMD yarns may also improve uniformity of the papermaking surface at the transition points themselves. If such yarns are not used, the papermaking surface knuckle formed by the top CMD yarn directly over the transition point may be lower than the remainder of the knuckles formed by the top CMD yarns because the stitching MD yarns at that location dive down at a steeper angle and hence provide less support to the top CMD yarn. By using larger diameter or higher modulus yarns on the top CMD yarn positions that straddle the transition point it is possible to raise the height of the top CMD yarn that passes over the transition point at the transition point location.

Notably, in the bottom fabric layers 104, 204, 304, 404 of fabrics 100, 200, 300, 400, 500 respectively, the set of bottom MD yarns and the set of bottom CMD yarns form a machine-side surface having only "single float" machine direction knuckles. By a "single float" machine-side machine direction knuckle it is meant that when the bottom fabric layer is viewed from the top, no machine direction yarn passes under more than one consecutive cross machine direction yarn (such that the MD yarn is on the machine-side surface) before passing back to the top surface of the bottom fabric layer. In a preferred embodiment of the triple layer forming fabrics of the present invention, the bottom fabric layer is woven so as to have a machine side surface composed exclusively of machine side "single float" machine direction knuckles.

The fabrics pictured and otherwise described and claimed herein may be employed in a variety of applications, including forming fine paper grades, tissue paper, brown paper and newsprint, but is especially beneficial for fine paper, newsprint and brown paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top CMD yarns, and all of the MD yarns is between about 0.10 and 0.20 mm, and the diameter of the bottom CMD yarns is between about 0.22 and 0.50 mm. Those of skill in the art will appreciate that yarns having diameters outside the above ranges may be used in certain applications. In one embodiment of the present invention, the top CMD yarns and all of the MD yarns have diameters between about 0.15 and 0.17 mm, and the diameter of the bottom CMD yarns is between about 0.25 and 0.40 mm to provide fabrics with a target top mesh of 75×75 yarns per inch. Fabrics employing these yarn sizes may be implemented with polyester yarns or a combination of polyester and nylon yarns.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

The foregoing embodiments are illustrative of the present invention, and are not to be construed as limiting thereof. The invention is defined by the following claims, with equivalents of the claims to be included therein.

That which is claimed:

1. A triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface, the bottom MD yarns forming bottom MD knuckles as they pass below bottom CMD yarns; and a pair of additional MD yarns disposed on either side of each top MD yarn, wherein the first yarn of each pair of additional MD yarns weaves exclusively in the top fabric layer and the second yarn of each pair of additional MD yarns completes the weave of the first yarn of each pair of additional MD yarns on the papermaking surface and also weaves with the bottom fabric layer beneath a bottom CMD yarn to form a bottom MD stitching yarn knuckle so as to bind the top fabric layer and the bottom fabric layers together;

wherein each bottom stitching yarn knuckle is formed below a bottom CMD yarn under which an adjacent bottom MD yarn forms a bottom MD knuckle.

2. The triple layer papermaker's forming fabric defined in claim 1, wherein at least some of the bottom MD knuckles are formed under a bottom CMD yarn under which an adjacent bottom CMD yarn also forms a bottom MD knuckle.

3. The triple layer papermaker's forming fabric defined in claim 1, wherein each repeat unit includes eight bottom CMD yarns and sixteen top CMD yarns.

4. The triple layer papermaker's forming fabric defined in claim 3, wherein each bottom CMD yarn passes over two adjacent bottom CMD yarns, beneath the next adjacent bottom CMD yarn, above the next two adjacent bottom CMD yarns, beneath the next adjacent bottom CMD yarn, above the next bottom adjacent CMD yarn, and beneath the next adjacent bottom CMD yarn.

5. The triple layer papermaker's forming fabric defined in claim 3, wherein each repeat unit includes four top MD yarns and four bottom MD yarns.

6. The triple layer papermaker's forming fabric defined in claim 3, wherein each first yarn of a stitching yarn pair forms five top MD knuckles with the top CMD yarns, and each second yarn of a stitching yarn pair forms three top MD knuckles with the top CMD yarns.

7. The triple layer papermaker's forming fabric defined in claim 1, wherein the top MD yarns, the top CMD yarns, and the stitching MD yarn pairs form a top fabric layer having a plain weave pattern.

8. The triple layer papermaker's forming fabric defined in claim 1, wherein each bottom MD yarn passes below two non-adjacent bottom CMD yarns in each repeat of the fabric.

9. A triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface, the bottom MD yarns forming bottom MD knuckles as they pass below bottom CMD yarns; and a pair of additional MD yarns disposed on either side of each top MD yarn, wherein the first yarn of each pair of additional MD yarns weaves exclusively in the top fabric layer and the second yarn of each pair of additional MD yarns completes the weave of the first yarn of each pair of additional MD yarns on the papermaking surface and also weaves with the bottom fabric layer beneath a bottom CMD yarn to form a bottom MD stitching yarn knuckle so as to bind the top fabric layer and the bottom fabric layers together;

wherein each of the additional MD yarns forms knuckles by passing over the top CMD yarns, and wherein the number of knuckles formed by the first yarn of each pair of additional MD yarns differs from the number of knuckles formed by the second yarn of each pair.

10. The triple layer papermaker's forming fabric defined in claim 9, wherein each bottom stitching yarn knuckle is formed below a bottom CMD yarn under which an adjacent bottom MD yarn forms a bottom MD knuckle.

11. The triple layer papermaker's forming fabric defined in claim 9, wherein at least some of the bottom MD knuckles are formed under a bottom CMD yarn under which an adjacent bottom CMD yarn also forms a bottom MD knuckle.

12. The triple layer papermaker's forming fabric defined in claim 9, wherein each repeat unit includes eight bottom CMD yarns and sixteen top CMD yarns.

13. The triple layer papermaker's forming fabric defined in claim 12, wherein each bottom CMD yarn passes over two adjacent bottom CMD yarns, beneath the next adjacent bottom CMD yarn, above the next two adjacent bottom CMD yarns, beneath the next adjacent bottom CMD yarn, above the next bottom adjacent CMD yarn, and beneath the next adjacent bottom CMD yarn.

14. The triple layer papermaker's forming fabric defined in claim 12, wherein each repeat unit includes four top MD yarns and four bottom MD yarns.

15. The triple layer papermaker's forming fabric defined in claim 12, wherein each first yarn of a stitching yarn pair forms five top MD knuckles with the top CMD yarns, and each second yarn of a stitching yarn pair forms three top MD knuckles with the top CMD yarns.

16. The triple layer papermaker's forming fabric defined in claim 9, wherein the top MD yarns, the top CMD yarns, and the stitching MD yarn pairs form a top fabric layer having a plain weave pattern.

17. The triple layer papermaker's forming fabric defined in claim 9, wherein each bottom MD yarn passes below two non-adjacent bottom CMD yarns in each repeat of the fabric.

18. A method of making paper, comprising:

(a) providing a triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface, the bottom MD yarns forming bottom MD knuckles as they pass below bottom CMD yarns; and a pair of additional MD yarns disposed on either side of each top MD yarn, wherein the first yarn of each pair of additional MD yarns weaves exclusively in the top fabric layer and the second yarn of each pair of additional MD yarns completes the weave of the first yarn of each pair of additional MD yarns on the papermaking surface and also weaves with the bottom fabric layer beneath a bottom CMD yarn to form a bottom MD stitching yarn knuckle so as to bind the top fabric layer and the bottom fabric layers together;

wherein each bottom stitching yarn knuckle is formed below a bottom CMD yarn under which an adjacent bottom MD yarn forms a bottom MD knuckle, (b) applying paper stock to said papermaker's forming fabric; and (c) removing moisture from said paper stock.

19. A triple layer papermaker's forming fabric comprising:

a set of top CMD yarns;

a set of top MD yarns interwoven exclusively with the top CMD yarns to form at least part of a top fabric layer having a papermaking surface;

a set of bottom CMD yarns;

a set of bottom MD yarns interwoven exclusively with the bottom CMD yarns to form at least part of a bottom fabric layer having a machine side surface, the bottom MD yarns forming machine side MD knuckles as they pass below respective bottom CMD yarns; and a set of stitching MD yarn pairs, wherein at least one of the stitching MD yarns in each stitching MD yarn pair weaves in both the top fabric layer and the bottom fabric layer and wherein the stitching MD yarns in each stitching MD yarn pair are woven such that at locations where the first of the two stitching MD yarns in each stitching MD yarn pair weaves in the top fabric layer the second of the two stitching MD yarns in the stitching MD yarn pair drops below the top fabric layer so that together the two stitching MD yarns in each stitching MD yarn pair complete the weave in the top fabric layer, and wherein at least some of the stitching MD yarns in the stitching MD yarn pairs bind the top fabric layer and the bottom fabric layer together.

20. The papermaker's fabric defined in claim 19, wherein the fabric is woven on 12 harnesses, and wherein the bottom MD knuckles define a broken twill pattern.

21. The papermaker's fabric defined in claim 19, wherein one stitching yarn of each pair forms a bottom MD stitching knuckle as it passes below a bottom CMD yarn, and wherein each bottom MD knuckle is formed below a bottom CMD yarn adjacent a bottom MD stitching knuckle formed under the same bottom CMD yarn.

22. The papermaker's fabric defined in claim 21, wherein the fabric is woven on 24 harnesses.

23. The papermaker's fabric defined in claim 19, wherein the ratio of top MD yarns to stitching yarn pairs is 1:1.

24. The papermaker's fabric defined in claim 19, wherein the ratio of MD yarns to stitching yarn pairs is 3:1.

25. The papermaker's fabric defined in claim 19, wherein the top MD yarns, top CMD yarns, and stitching yarns are interwoven such that the papermaking surface has a herringbone pattern.

26. The papermaker's fabric defined in claim 25, wherein the fabric is woven on 8 harnesses.

* * * * *

UNITED STATES PATENT AND TRADEMARK OFFICE

CERTIFICATE OF CORRECTION

PATENT NO. : 7,441,566 B2
APPLICATION NO. : 10/548637
DATED : October 28, 2008
INVENTOR(S) : Ward It is certified that error appears in the above-identified patent and that said Letters Patent is hereby corrected as shown below:

On the Title Page:

Please add --(30) Application Priority Data 10/391,827 March 19, 2003--

Signed and Sealed this

Thirtieth Day of December, 2008

JON W. DUDAS
*Director of the United States Patent and Trademark Office*